US006193353B1

(12) United States Patent
Vives et al.

(10) Patent No.: US 6,193,353 B1
(45) **Date of Patent: *Feb. 27, 2001**

(54) TRANSLATIONAL INKJET SERVICING MODULE WITH MULTIPLE FUNCTIONS

(75) Inventors: Joan Carles Vives, San Diego, CA (US); Martin Urrutia; Jesus Garcia Maza, both of Barcelona (ES); Brian Canfield, Encinitas; Richard A. Becker, Poway, both of CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/034,970

(22) Filed: Mar. 4, 1998

Related U.S. Application Data

(63) Continuation-in-part of application No. 08/398,709, filed on Mar. 6, 1995, now Pat. No. 5,898,445, and a continuation-in-part of application No. 08/811,552, filed on Mar. 4, 1997, now Pat. No. 6,042,216.

(51) Int. Cl.[7] ..... B41J 2/165
(52) U.S. Cl. ..... 347/29; 347/33
(58) Field of Search ..... 347/33, 29, 36, 347/22, 24, 19

(56) References Cited

U.S. PATENT DOCUMENTS

| | | | | |
|---|---|---|---|---|
| 4,870,431 | * | 9/1989 | Sousa et al. . | |
| 5,682,191 | * | 10/1997 | Barrett et al. | 347/104 |
| 5,812,157 | * | 9/1998 | Nguyen et al. | 347/33 |
| 5,898,445 | * | 4/1999 | Becker et al. | 347/33 |
| 6,000,780 | * | 12/1999 | Schwiebert et al. | 347/33 |
| 6,042,216 | * | 3/2000 | Gacia et al. | 347/29 |

FOREIGN PATENT DOCUMENTS

| | | | | |
|---|---|---|---|---|
| 0590850 A2 | * | 4/1994 | (EP) | 347/33 |
| 4-04077263 | * | 3/1992 | (JP) | 347/33 |

* cited by examiner

*Primary Examiner*—N. Le
*Assistant Examiner*—Shih-Wen Hsieh

(57) ABSTRACT

An inkjet printing system with a translational inkjet service module. The system includes a carriage which moves along a scan axis over a print zone, with a plurality of printheads mounted on the carriage, each printhead having an array of nozzles for applying ink to the print media in the print zone. The service module has wipers for engagement with the array of nozzles during a period when the nozzles are not applying ink to the media. A motor moves the servicing module in a linear direction orthogonal to the scan axis in order to simultaneously wipe each array of nozzles. The servicing module also provides a capper function and a priming function.

18 Claims, 25 Drawing Sheets

| INK CARTRIDGES | FIRST SERVICE STATION | | | SECOND SERVICE STATION | | |
|---|---|---|---|---|---|---|
| | SPIT | WIPE | SCRAPE | CAP | PRIME | ---- |
| BLACK PRINTHEAD | SPIT | ---- | ---- | CAP | PRIME | WIPE | SCRAPE |
| CYAN PRINTHEAD | SPIT | ---- | ---- | CAP | PRIME | WIPE | SCRAPE |
| MAGENTA PRINTHEAD | SPIT | ---- | ---- | CAP | PRIME | WIPE | SCRAPE |
| YELLOW PRINTHEAD | SPIT | ---- | ---- | CAP | PRIME | WIPE | SCRAPE |

FIG. 27

TRANSLATIONAL POSITIONS OF SERVICE STATION

| COMPONENT ON SERVICE STATION | DOUBLE WIPER / FLEX CIRCUIT WIPER | PRIMER & CAPPERS | LABEL | SPITTOON | HANDLE |
|---|---|---|---|---|---|
| TYPE OF INTERACTION | NOZZLE PLATE / INTER-CONNECT | NOZZLE PLATE | OPTICAL SENSOR | INK DROPS | USER |
| PHYSICAL CONTACT | YES | YES | NO | NO | YES |

BACK

FRONT

TRANSLATIONAL INKJET SERVICING MODULE WITH MULTIPLE FUNCTIONS

CROSS-REFERENCE TO RELATED APPLICATIONS

The present application is a continuation-in-part application of U.S. Ser. No. 08/398,709 filed Mar. 6, 1995, now U.S. Pat. No. 5,898,445 issued Apr. 27, 1999 by Becker et al. entitled TRANSLATIONAL WIPING TECHNIQUE FOR A STATIONARY INKJET PRINTHEAD and also U.S. Ser. No. 08/811,552 filed Mar. 4, 1997, now U.S. Pat. No. 6,042,216 issued Mar. 28, 2000 by Jesus Garcia Maza et al entitled REPLACEABLE PRINTHEAD SERVICNG MODULE WITH MULTIPLE FUNCTIONS (WIPE/CAP/SPIT/PRIME) which applications are incorporated herein by reference.

The present application is related to the following co-pending commonly assigned applications, all of which are incorporated herein by reference: U.S. Ser. No. 08/811,405 filed Mar. 4, 1997 by Brian Canfield et al entitled MANUALLY REPLACEABLE PRINTHEAD SERVICING MODULE FOR EACH DIFFERENT INKJET PRINTHEAD; U.S. Ser. No. 08/810,485 by Rick Becker et al, filed on Mar. 3, 1997 entitled INKJET PRINTING WITH REPLACEABLE SET OF INK-RELATED COMPONENTS (PRINTHEAD/SERVICE MODULE/INK SUPPLY) FOR EACH COLOR OF INK; Ser. No. 09/031,115 entitled METHOD AND APPARATUS FOR LOCATING AN INKJET PRINTER CARRIAGE RELATIVE TO A SERVICE STATION filed Feb. 26, 1998 by Jesus Garcia Maza et.; and Ser. No. 09/034,886 entitled MODULAR PRINTHEAD SERVICE STATION WITH SELF-CONTAINED MOTORIZED COMPONENTS filed Mar. 4, 1998 by Urrutia et al.

FIELD OF THE INVENTION

This application relates generally to inkjet printing, and more particularly to online service station functions of spitting ink into a spittoon, wiping ink orifices, capping an array of nozzles on a printhead, and priming inkjet cartridges.

BACKGROUND TO INVENTION

Inkjet cartridges are now well known in the art and generally comprise a body containing an ink supply and having electrically conductive interconnect pads thereon and a printhead for ejecting ink through numerous nozzles in a printhead. In thermally activated inkjet cartridges, each cartridge has heater circuits and resistors which are energised via electrical signals sent through the interconnect pads on the cartridge. Each inkjet printer can have a plurality, often four, of cartridges each one having a different colour ink supply for example black, magenta, cyan and yellow, removably mounted in a printer carriage which scans backwards and forwards across a print medium, for example paper, in successive swaths. When the printer carriage correctly positions one of the cartridges over a given location on the print medium, a jet of ink is ejected from a nozzle to provide a pixel of ink at a precisely defined location. The mosaic of pixels thus created provides a desired composite image.

Inkjet cartridges are increasingly becoming more sophisticated and complex in their construction and longer lifetimes are also required of cartridges, particularly those for use with printers having an off-carriage ink reservoir which replenishes the cartridge's ink supply. This has lead to greater sophistication in the so-called "servicing" of cartridges by a printer. It is normal for printers to have a service station at which various functions are performed on the cartridges while they are mounted in the printer carriage such as wiping, spitting and capping, see for example U.S. Pat. No. 5,585,826. Wiping comprises moving a wiper of a specified material across the printhead of a cartridge to remove paper dust, ink spray and the like from the nozzle plate of the printhead. Spitting, ejecting ink into a spittoon in the service station, is performed to prevent ink in nozzles which have not been fired for some time from drying and crusting.

Some prior color inkjet pen cartridges functioned somewhat satisfactorily with no wiping and minimal capping. Other prior monochrome/color inkjet cartridges used in single cartridge printers were wiped and capped with relatively simple mechanisms of the type shown in U.S. Pat. No. 4,583,717.

Cartridges are capped by precisely moving the printer carriage, and often the cap too, within the service station, so that the cap mates with the printhead of the cartridge and forms a seal around the nozzle plate. Capping prevents ink on the printhead and in the nozzles from drying by providing the correct atmosphere around these components and thus reduces the risk of crusting and ink plug formation in the nozzles. Also the cartridge can often be primed while in the capped position by the application of a vacuum through the cap. It can thus be seen that an effective seal must be formed between the printhead and the cap to facilitate these functions. Caps are usually formed of a resiliently deformable material such as rubber and in use are ideally pressed against a printhead of a cartridge with a substantially constant force, the capping force, chosen so as to achieve an effective seal with the printhead. While this is relatively easily achieved for a printer carriage having a single cartridge, ensuring that all the cartridges of a printer carriage having a plurality of cartridges are effectively capped is considerably harder. A number of arrangements are known, see for example U.S. Pat. No. 5,563,638, in which a plurality of caps are mounted on a spring-loaded gimbal mechanism. See also U.S. Pat. No. 5,448,270 which discloses a substantially constant low capping force for each cap and cartridge pair.

BRIEF SUMMARY OF THE INVENTION

An inkjet printer has a printhead mounted in a carriage which periodically moves along a printhead path in a carriage scan direction to a stop position in a service station where an actuation device imparts translational motion to a wiper blade. The wiper blade moves along a linear wiping path orthogonal to the printhead path and across ink orifices on a nozzle surface of the printhead during a wiping operation. A two blade wiper blade component is removably mounted on a base and each wiper blade may be split to form a first blade section for wiping one column of ink orifices and a second blade section for simultaneously wiping another column of ink orifices on a nozzle surface of the printhead.

There is provided apparatus for capping a plurality of printheads of inkjet cartridges held within the printer carriage of an inkjet printer, the apparatus comprising a service station carriage having a plurality of capping means, each for capping the printhead of an inkjet cartridge, a service station assembly in which the service station carriage is mounted and which is movable in a capping direction between a first position at which the cartridges are not capped and a second position at which the cartridges are capped, wherein relative movement in the capping direction between the plurality of cartridges and the plurality of capping means is arrested by the abutment of the service station carriage against the printer carriage. By controlling the distance between the service station carriage and the printer carriage the capping forces between a particular capping means and respective printhead are determined only by the tolerances related to the particular capping means and printhead pair and not by those related to other pairs of capping means and printheads mounted within the same service station and printer carriages.

Although the service station carriage may be rigidly mounted within the service station assembly, preferably the service station carriage is resiliently biased in the capping direction within the service station assembly by biasing means and the biasing means exert a force on the service station carriage which is greater than the total expected forces between the plurality of cartridges and the plurality of capping means so as to ensure abutment between the service station carriage and the printer carriage.

In a preferred embodiment, the service station carriage is gimbal mounted within the service station assembly.

Advantageously, an uppermost side of the service station carriage comprises a plurality of mechanical stops for abutment with a corresponding plurality of mechanical stops located on a lowermost side of the printer carriage. These mechanical stops abut when the service station carriage and printer carriage are moved towards each other and thus act so as to arrest relative movement in the capping direction between the plurality of cartridges and the plurality of capping means.

Although the capping apparatus provided by the present invention may be advantageously utilised with caps which are designed to be mounted to the printer service station for the life of the printer, preferably the caps are mounted on a service module which is easily removable from the service station carriage by a user of the printer. Removable service modules allow the caps to be exchange frequently, for example every time a cartridge is replaced its associated service module may also be replaced. This ensures that the cap of the service module does not deteriorate in performance unduly.

To facilitate removable service modules, the service station carriage preferably comprises a plurality of slots each for slidably receiving a service module. Each slot of the service station may comprise means for urging the service module against a datum within the service station carriage with a force greater than the total expected forces between the plurality of cartridges and the plurality of capping means. This ensures that the service module is not dislodged from its datum position during a capping operation.

According to a further aspect of the present invention there is provided apparatus for capping a plurality of printheads of inkjet cartridges mounted within a carriage, comprising a plurality of capping means mounted on a common support member and biasing means for biasing the common support member towards the plurality of printheads. Relative movement in the capping direction between the capping means and the printheads is limited by a mechanical stop positioned so that the distance between each of the capping means and a respective printhead when the mechanical stop is encountered is such that an effective seal is formed between the capping means and the printhead and wherein the biasing force provided by the biasing means is sufficiently large to ensure that in use the mechanical stop is encountered.

According to a still further aspect of the present invention there is provided a method of capping a plurality of inkjet cartridges held within the carriage of an inkjet printer, each cartridge having a printhead for ejecting ink. The method comprising the steps of moving the printer carriage within the printer to a service area, moving a service station carriage having a plurality of wipers and capping means horizontally into a position under the printhead nozzle plate; then moving the service station upwardly towards the printer carriage with a force greater than the total expected capping forces between the cartridges and the capping means.

Moreover, the service station carriage is incorporated into a service station module having self-contained motorized components for a primer assembly horizontal/vertical positioning of the service station carriage, and an exhaust fan.

A more complete understanding of the present invention and other objects, aspects, aims and advantages thereof will be gained from a consideration of the following description of the preferred embodiment read in conjunction with the accompanying drawings provided herein.

BRIEF DESCRIPTION OF THE DRAWINGS

FIG. 27 shows the various functional positions of the printhead service module of FIG. 26.

DETAILED DESCRIPTION OF THE PREFERRED EMBODIMENT OF THE INVENTION

It will be appreciated that the service station system of the present invention may be used with virtually any inkjet printer, however one particular inkjet printer will first be described in some detail, before describing the system of the invention.

Figure 1:
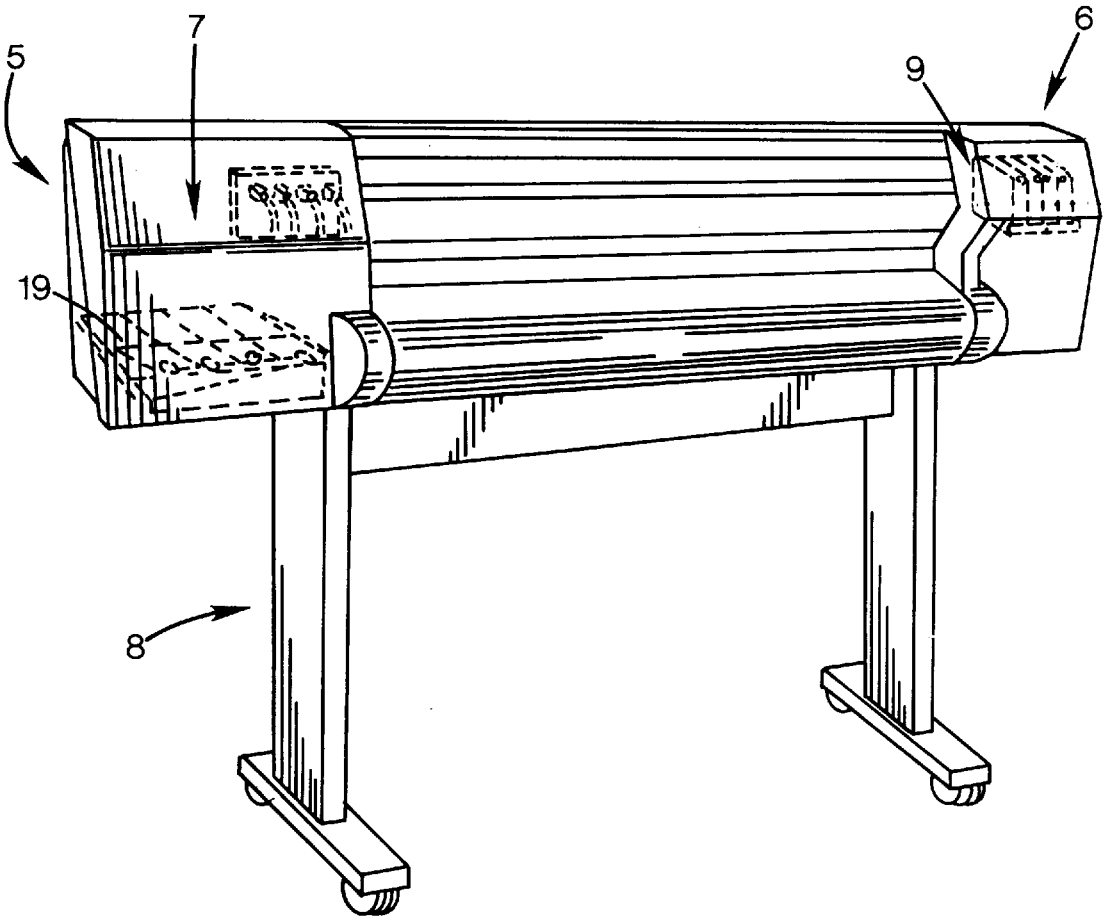
FIG. 1 is a perspective view of a large-format inkjet printer with which the present invention may be utilised.

FIG. 1 shows a perspective schematic view of a thermal inkjet large-format printer having a housing 5 with right and left covers respectively 6 and 7, mounted on a stand 8. A print media such as paper is positioned along a vertical or media axis by a media axis drive mechanism (not shown). As is common in the art, the media drive axis is denoted as the X axis and the carriage scan axis is denoted as the Y axis.

Figure 2:
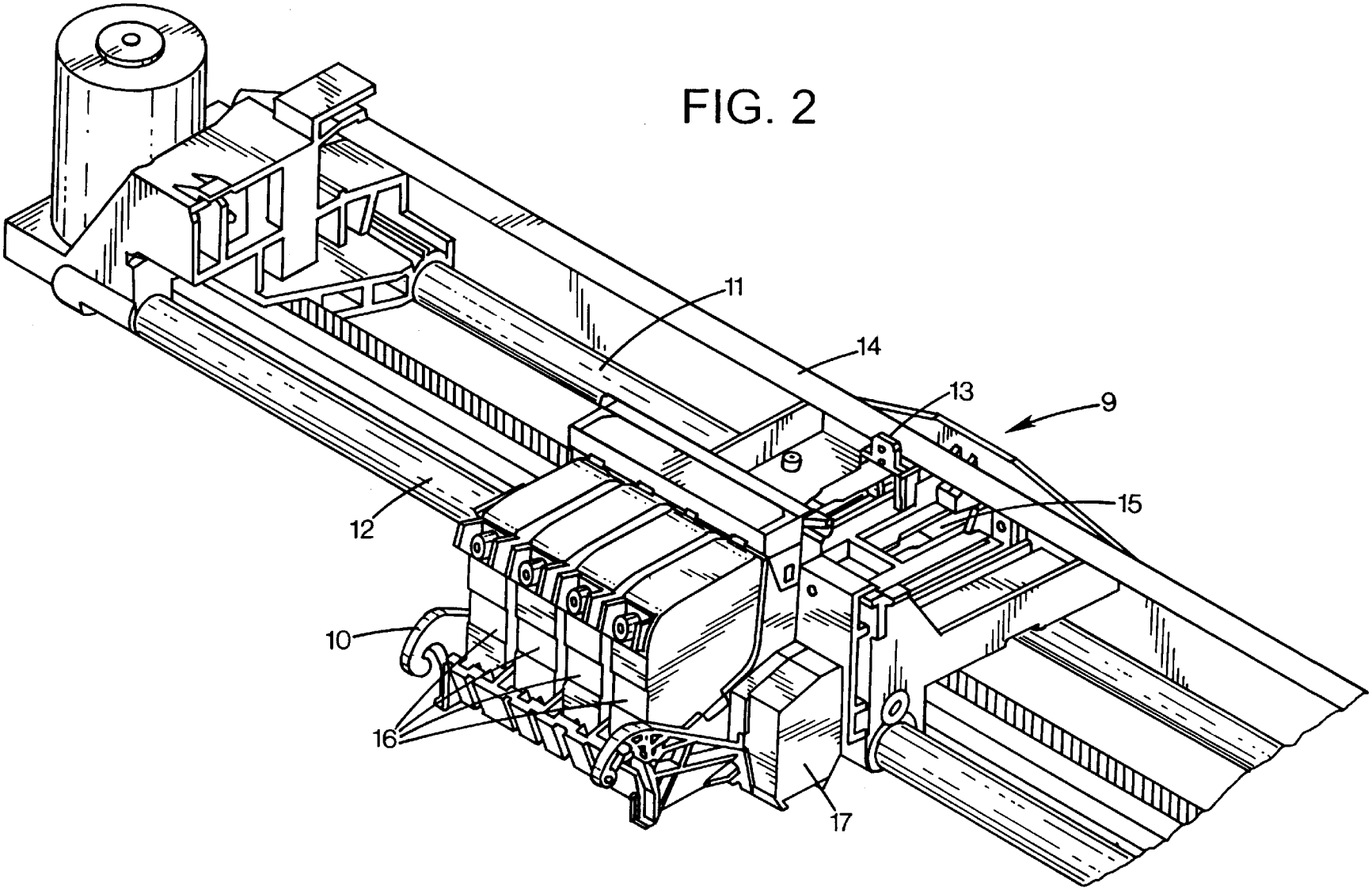
FIG. 2 is a schematic drawing of components within the print zone of the printer of FIG. 1.
Figure 3:
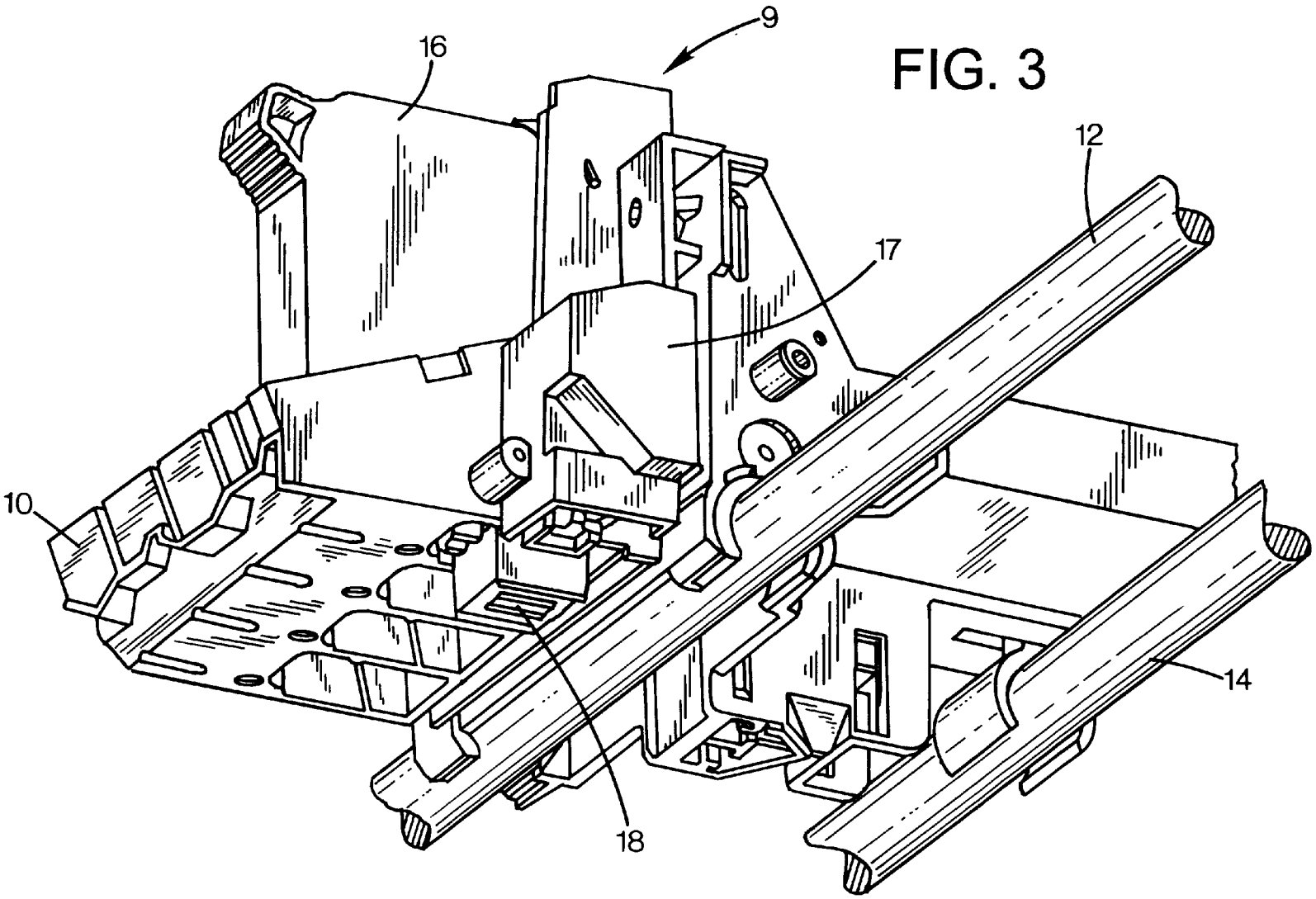
FIG. 3 is a side bottom view of the carriage assembly of the printer of FIG. 1.

The printer has a carriage assembly 9 shown in phantom under cover 6 and more clearly in FIG. 2 which is a perspective view of the print zone of the printer. The carriage assembly 9 has a body which is mounted for reciprocal movement along slider rods 11 and 12 and a printer carriage 10 for holding four inkjet cartridges 16 each holding ink of a different colour for example black, yellow, magenta and cyan. The cartridges are held in a close packed arrangement and each may be selectively removed from the printer carriage 10 for replacement by a fresh cartridge. The printheads of the cartridges 16 are exposed through openings in the printer carriage 10 facing the print media. On the side of the printer carriage 10 is mounted an optical sensor 17 for optically sensing test patterns printed by the cartridges 16. The carriage assembly body further retains an optical encoder 13 for determining the position of the carriage in the Y axis by interaction with an encoder strip 14, and the circuitry 15 required for interface to the heater circuits in the inkjet cartridges 16. FIG. 3 is a side-bottom perspective view of the carriage assembly 9 which better shows the mounting of the carriage and the protrusion of a printhead 18 of an inkjet cartridge 16 through the printer carriage 10 towards the print media.

Figure 4:
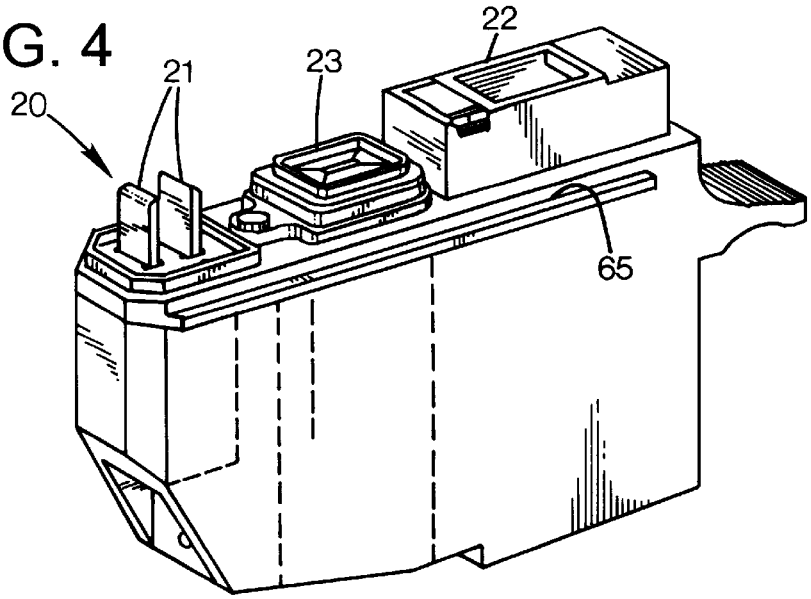
FIG. 4 is a perspective view of a service module having a cap which may be used with the present invention.

Referring again to FIG. 1 the printer has a set of replaceable ink supply odules 19 in the lefthand side of the printer (shown in phantom under the cover 7) and a set of replaceable service station modules mounted in the service station at the right-hand side of the printer (not shown). FIG. 4 shows a service station module 20 having dual wipers 21 at one end, a spittoon 22 at the other end and a cap 23 at an intermediate position. The printer has one service station module 20 per cartridge and each service station module is mounted in a service station carriage 24, shown in FIG. 5, in the service station unit 25 of the printer. The service station carriage 24 has four slots 26 for receiving service modules 20. The whole of the service station carriage is moved in two directions in a complex manner by the service station unit 25 so as to engage and disengage the carriage assembly 9 when required for servicing of the cartridges 16. The movement of the service station carriage 24 is detected and controlled by means of a motion sensor mounted on an arm 27 extending from the side of the carriage 24.

Further details of printers of the type described are disclosed in the co-pending commonly assigned application Ser. No. 08/810485 by Rick Becker et al, filed on Mar. 3, 1997 entitled INKJET PRINTING WITH REPLACEABLE SET OF INK-RELATED COMPONENTS (PRINTHEAD/SERVICE MODULE/INK SUPPLY) FOR EACH COLOR OF INK which is incorporated herein by reference.

Figure 6A:
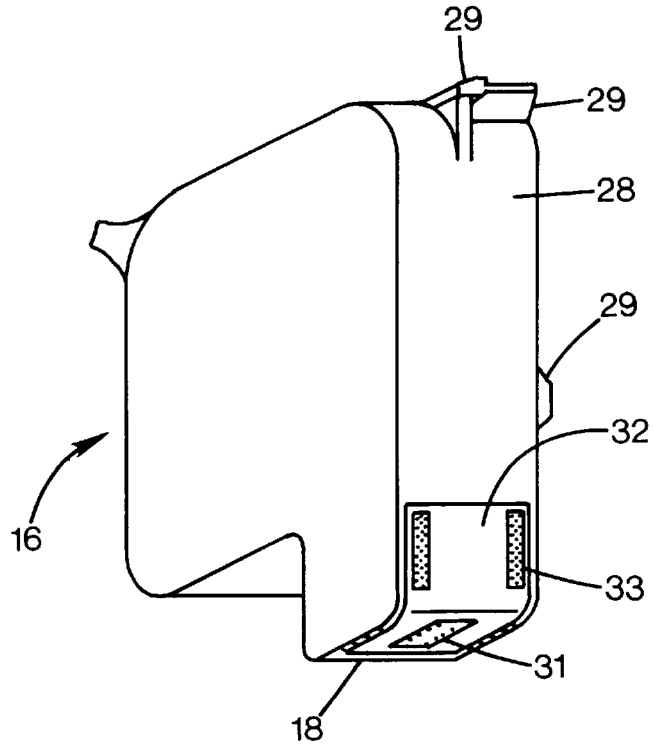
FIGS. 6A and 6B show an inkjet cartridge which may be used with the present invention.
Figure 6B:
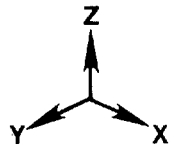
Figure 6B:
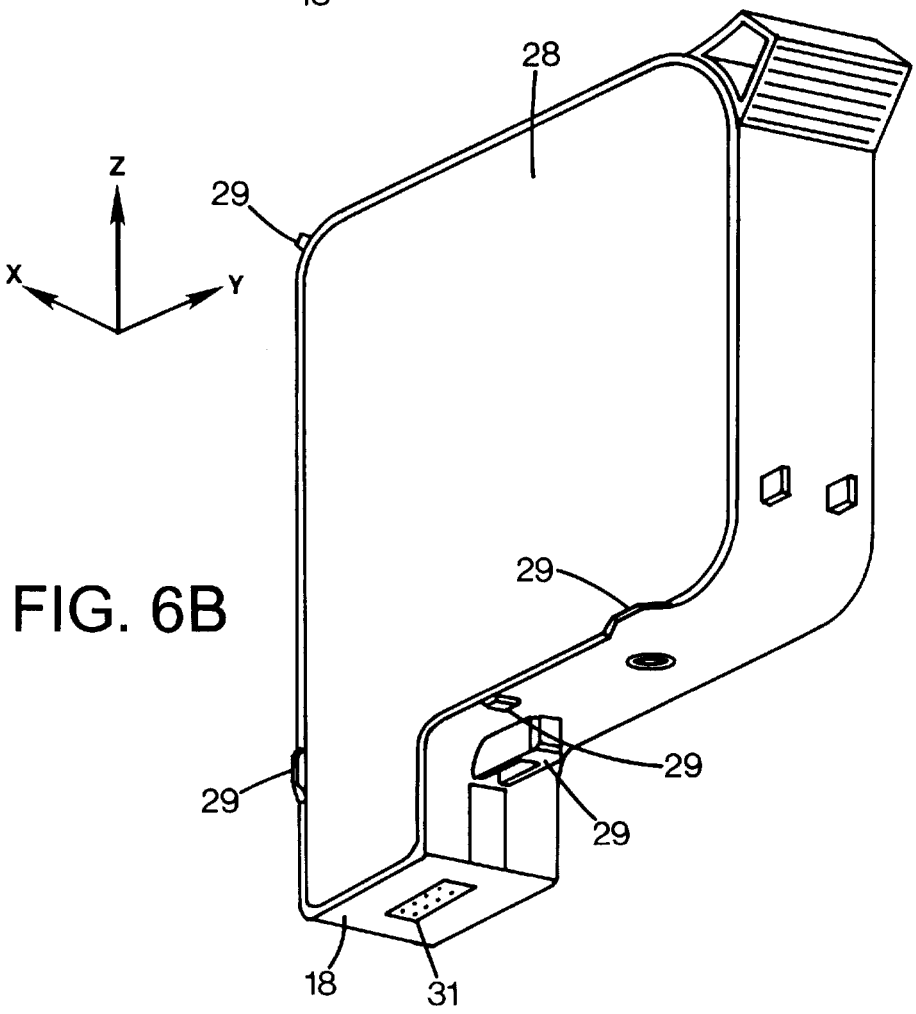
Figure 7:
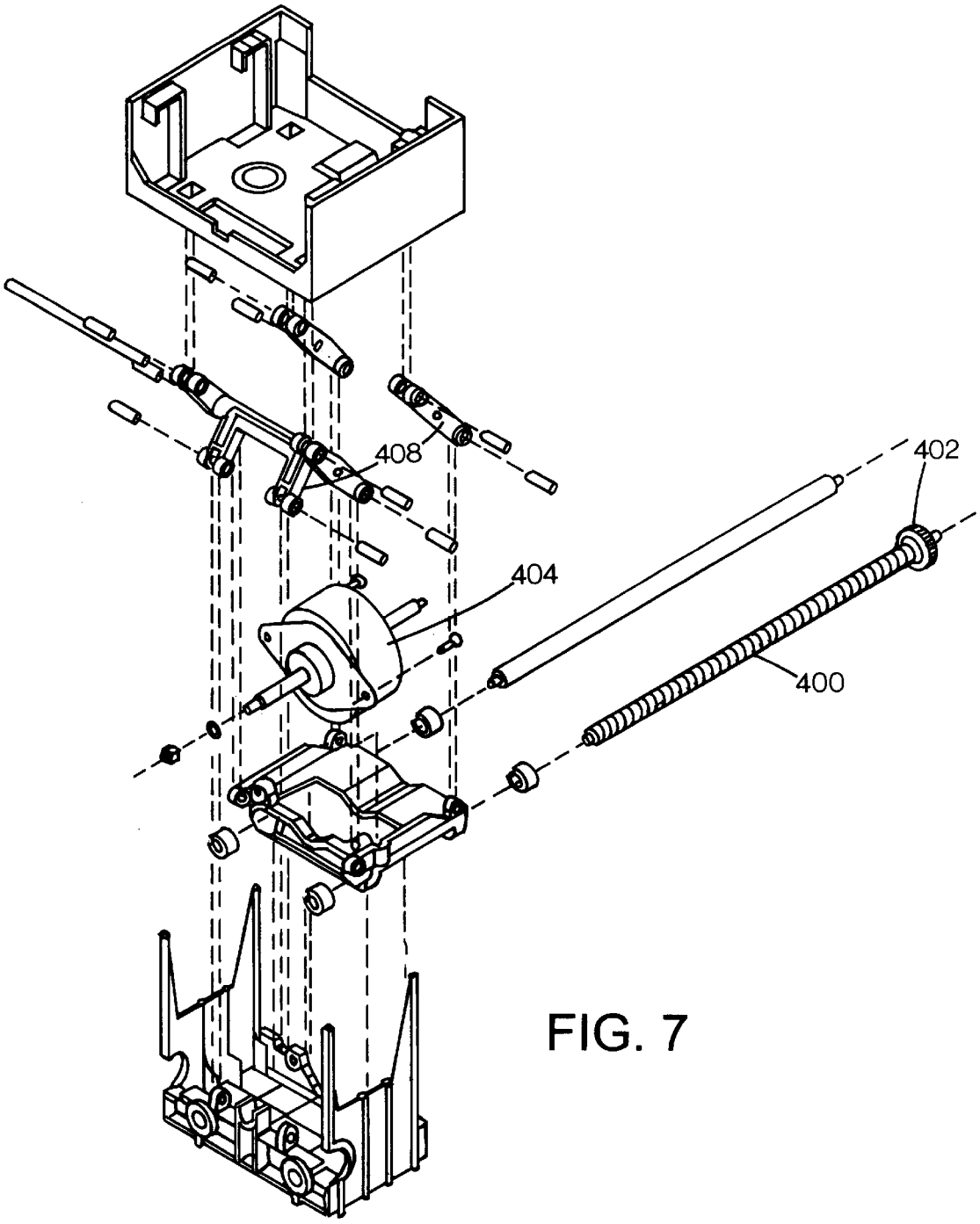
FIG. 7 is an exploded view of the horizontal motor mechanism of the service station unit of FIG. 5.
Figure 8:
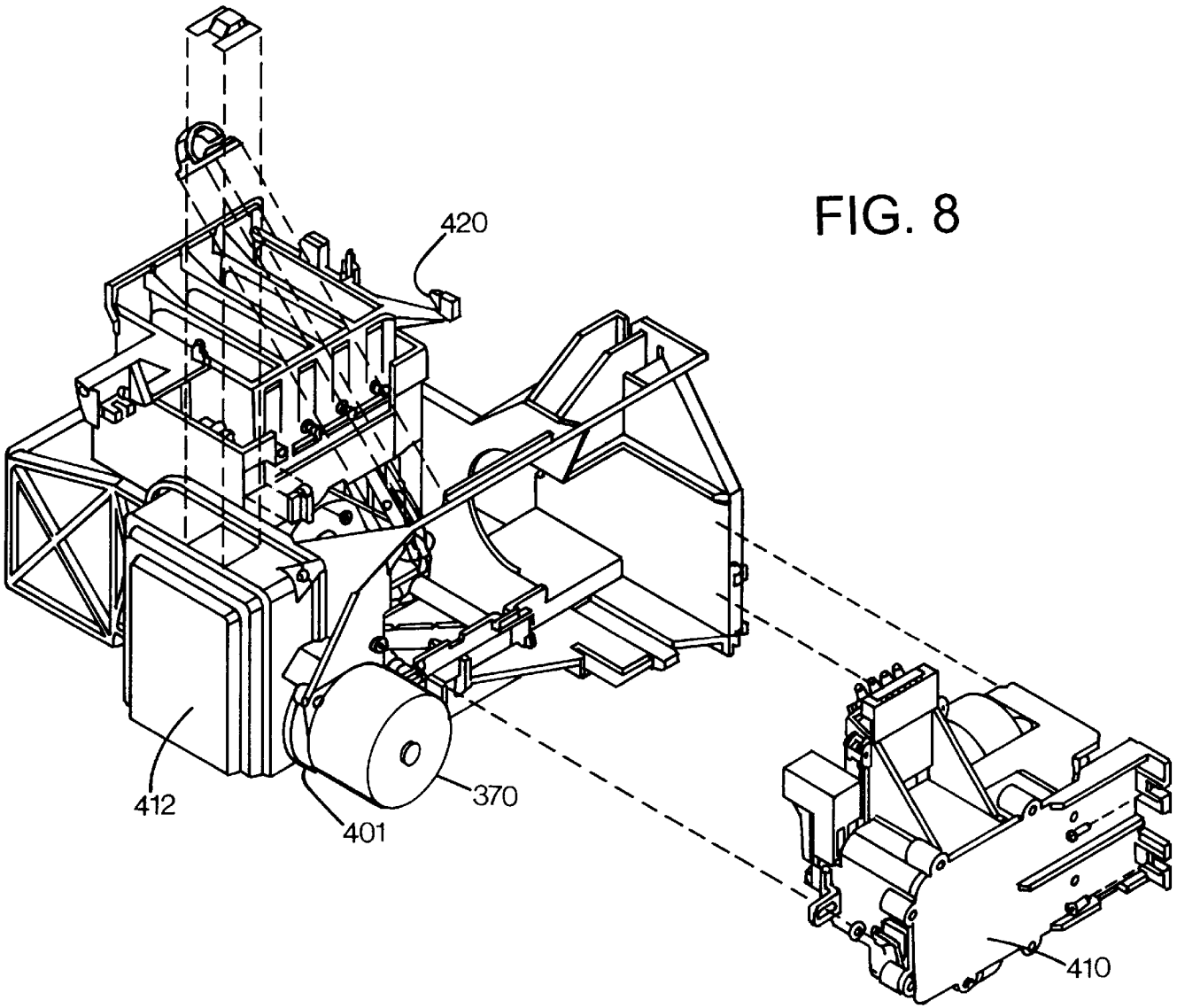
FIG. 8 shows the primer assembly separated from the service station unit of FIG. 5.
Figure 9:
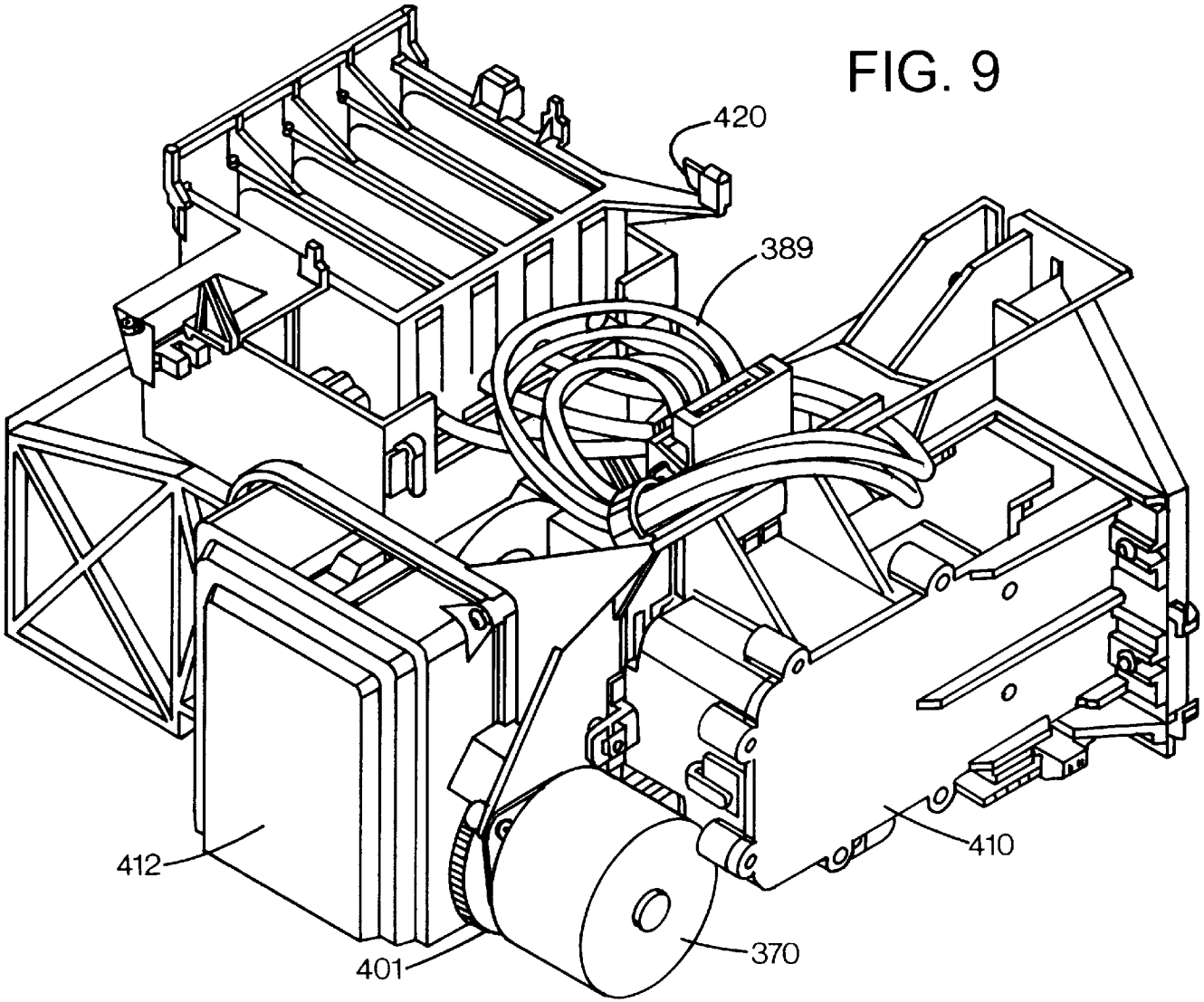
FIG. 9 is a rear perspective view of the service station unit of FIG. 5.

FIGS. 6A and 6B show an inkjet cartridge 16 which can be used with the printer shown in FIG. 1 and with the system of the present invention. The cartridge has a body 28 having an internal ink supply and various alignment features or datums 29, and keying elements 30. The printhead 18 has a nozzle plate 31 and an insulating tape 32 having electrically conductive interconnect pads 33 thereon.

Figure 10:
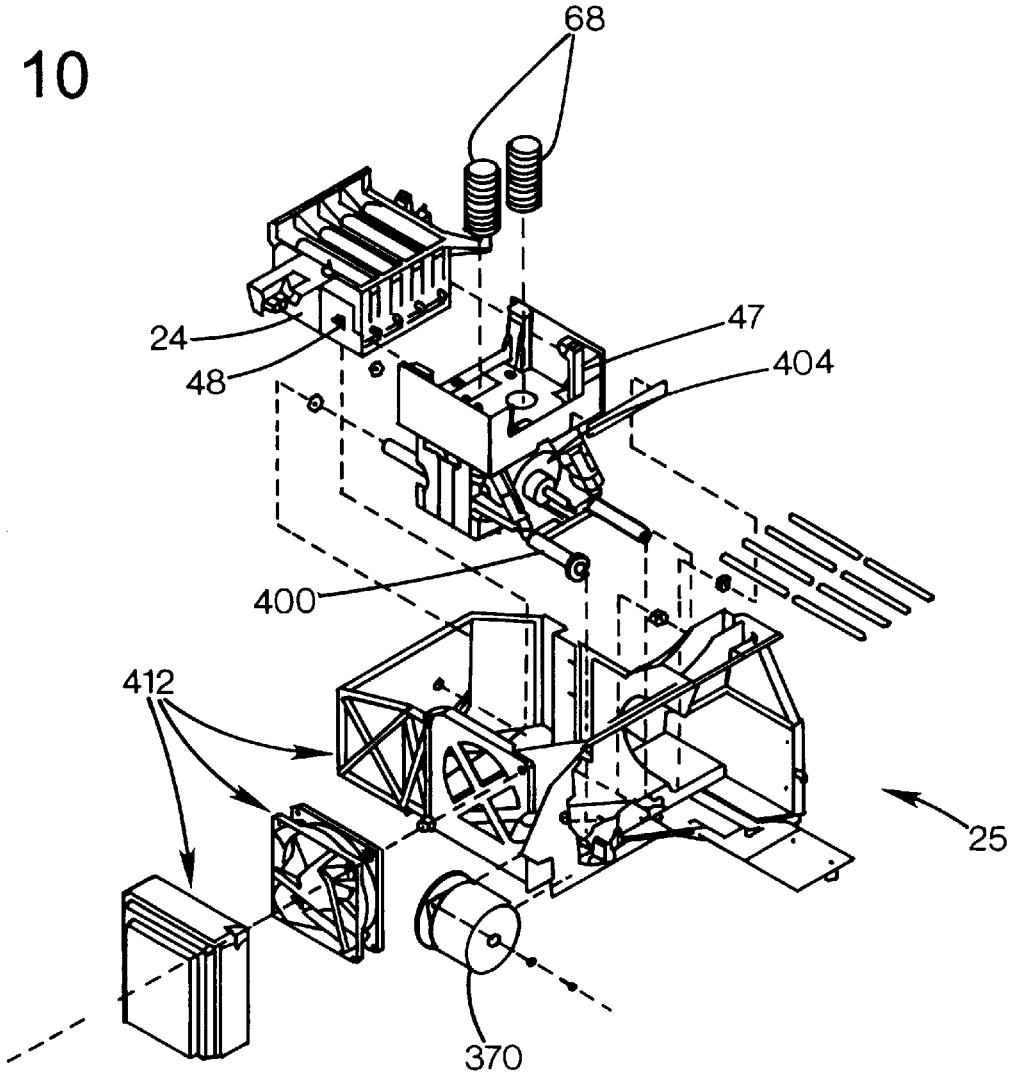
FIG. 10 is an exploded view of the service station unit of the printer of FIG. 1.

Returning now, with reference to FIGS. 5 and 10, to the description of the service station unit 25, the service station carriage 24 is mounted within a service station assembly 47. As best seen in the exploded view of the service station unit 25 shown FIG. 10, the service station carriage 24 is mounted on two springs 68 within the service station assembly 47. Each of these springs 68 exert a force F' chosen so that 2F' is greater than the total expected capping forces between the four cartridges 16 mounted within the printer carriage 10 and the four caps 23 of the four service station modules 20 mounted within the slots 26 of the service station carriage 24. The service station carriage 24 has four pegs 48, two extending from each of its outer side walls 49, (shown in FIG. 11) which abut downwardly facing arms 50 extending from the inner side walls 51 (shown in FIG. 12) of the service station assembly 47. The service station carriage 24 is upwardly biased by the springs 68 acting against its base 52 until the pegs 48 on its walls 49 contact the arms 50 of the service station assembly 47. This provides a "floating" mounting to the service station carriage 24 and allows it to gimbal to some extent to mate with the printer carriage 10.

Each of the slots 26 of the service station carriage 24 has a Z datum ridge 66 along a top portion of the slot which engages a corresponding datum ledge 65 (as shown in FIG. 4) along both top edges of the service module 20. Each slot 26 also comprises an upwardly biased spring arm (not shown) which ensures that each service module 20 snaps into place in its respective slot 26 and is held against the datum ridge 49. The force generated by the spring arm is arranged to be far greater than the forces generated during capping of a printhead 18 by the cap 23 of a service module 20 to ensure that there is no movement of the service module 20 during the capping operation.

Figure 5:
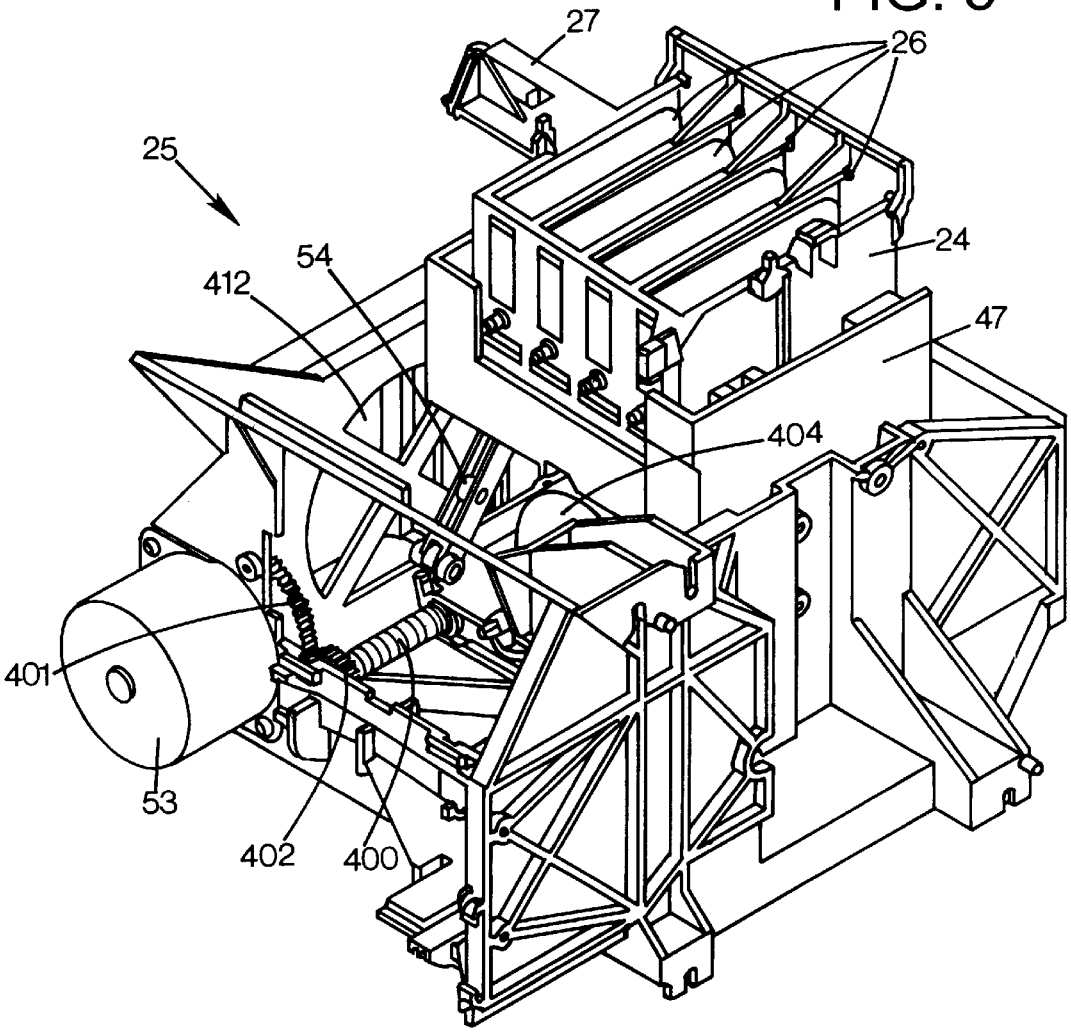
FIG. 5 is a perspective rear view of the service station unit of the printer of FIG. 1.
Figure 12:
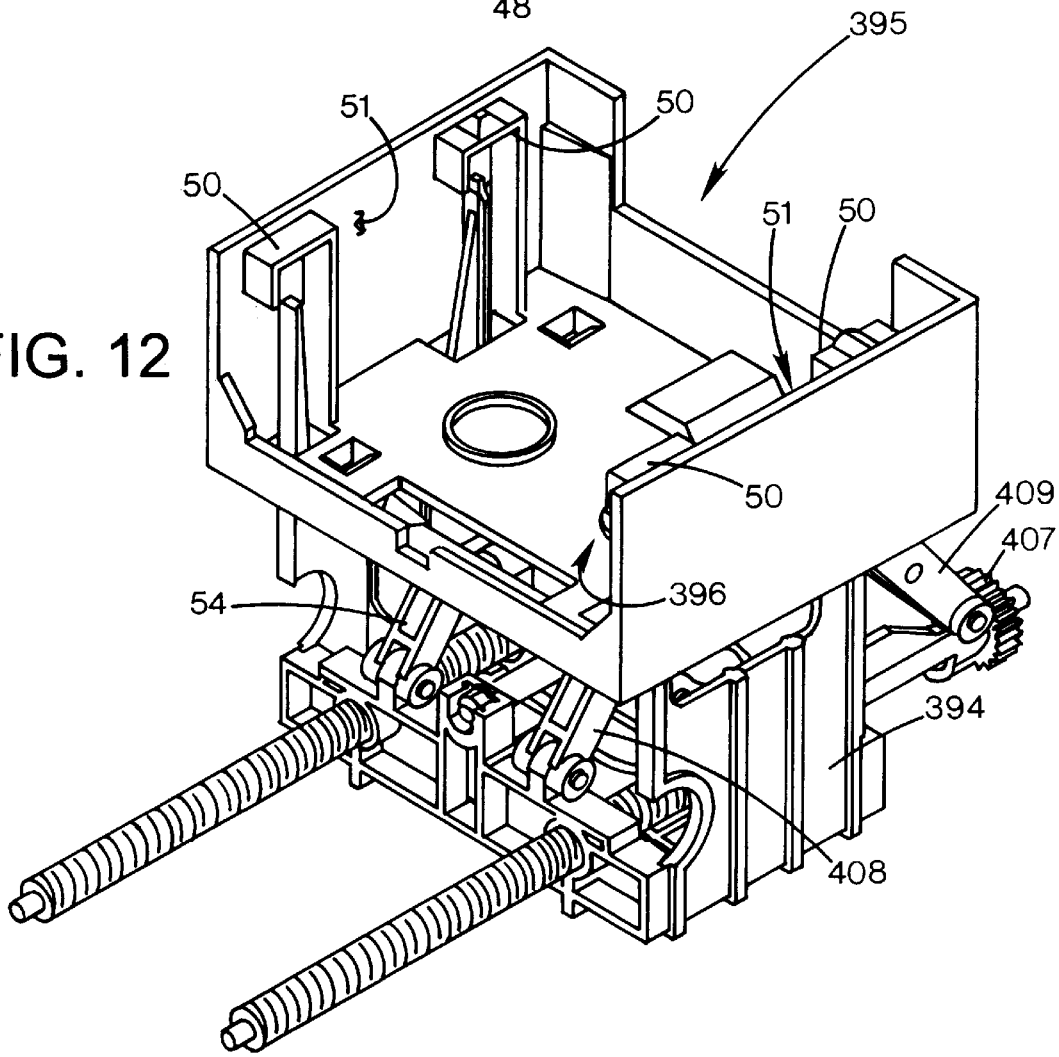
FIG. 12 shows a service station assembly on which the service station carriage of FIG. 11 is mounted.

Referring to FIGS. 5 and 12 the service station assembly 47 is movable in the X direction by a motor 53 which drives a worm drive, and in the Z direction (i.e. the capping direction) via a linkage 54.

Figure 11:
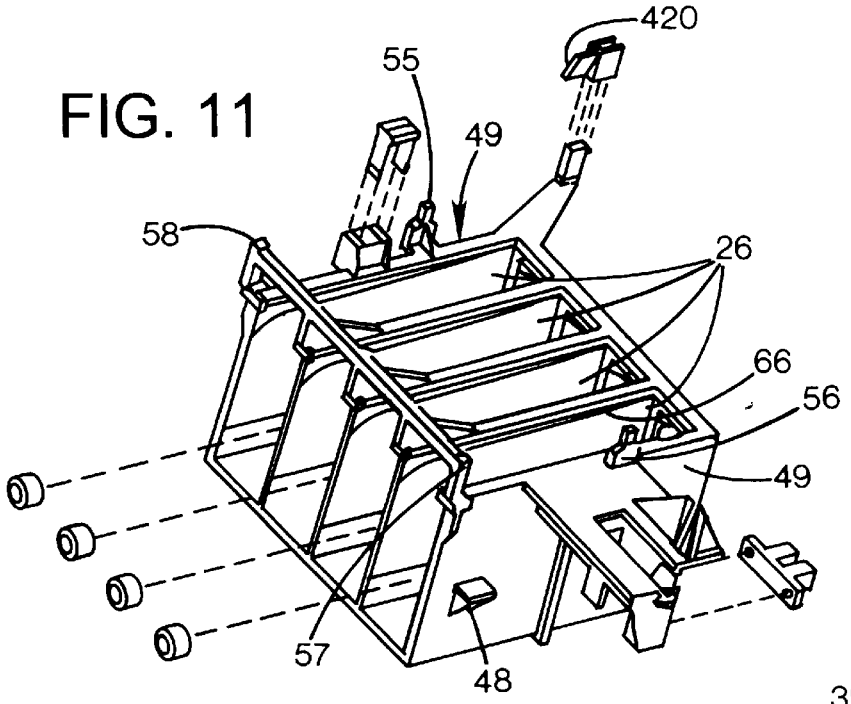
FIG. 11 shows a service station carriage according to an embodiment of the present invention.

Mechanical stops are provided on the upper surface of the service station carriage 24, as shown in FIG. 11, in the form of two free-standing upwardly extending pins 55 and 56 and two linked pins 57 and 58.

Figure 13:
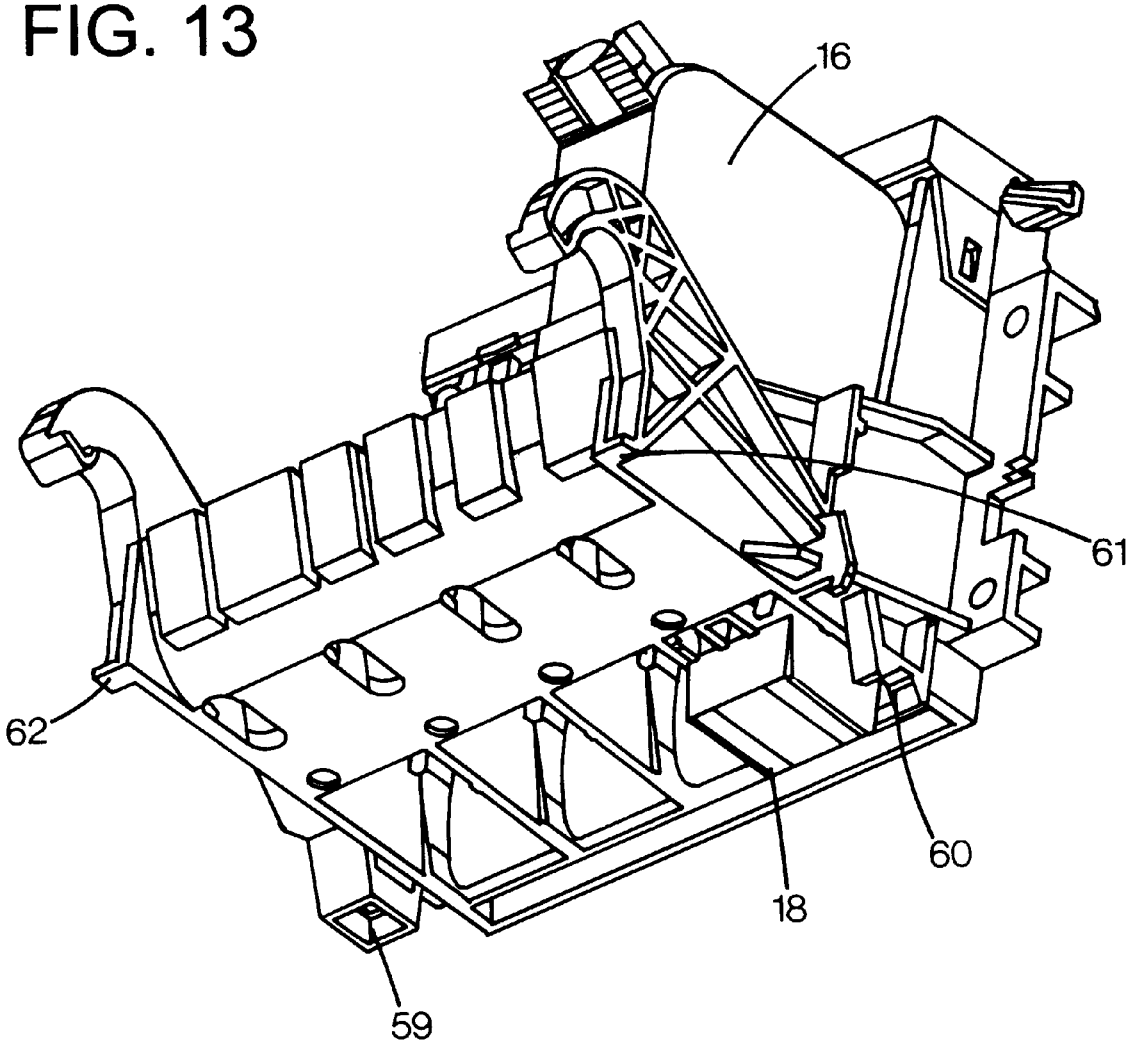
FIG. 13 is a lower perspective view of the printer carriage of the printer of FIG. 1 with a single cartridge installed.

FIG. 13 is a lower perspective view of the printer carriage 10 with a single cartridge 16 installed in a compartment showing the printhead 18 of the cartridge protruding through the base of the printer carriage for engagement with a cap 23 of a service module 20 mounted in the service station carriage 24 below the printer carriage. Also shown on the lower surface of the printer carriage 10 are mechanical stops 59, 60, 61 and 62 for engagement with the pins 55, 56, 57 and 58 of the service station carriage 24. Mechanical stop 59 is in the form of an inverted pyramid into which the pin 55 may enter to provide referencing between the printer carriage 10 and the service station carriage 24 in the X and Y directions in addition to the Z or capping direction. Mechanical stop 60 is in the form of a V-shaped slot into which pin 56 may enter to provide referencing in the X direction (in addition to the Z direction) so as to prevent rotation of the printer and service station carriages about the pin 55. Mechanical stops 61 and 62 are in the form of flat lands which provide referencing only in the Z direction by abutting against the pins 57 and 58 of the service station carriage 24.

Figure 14:
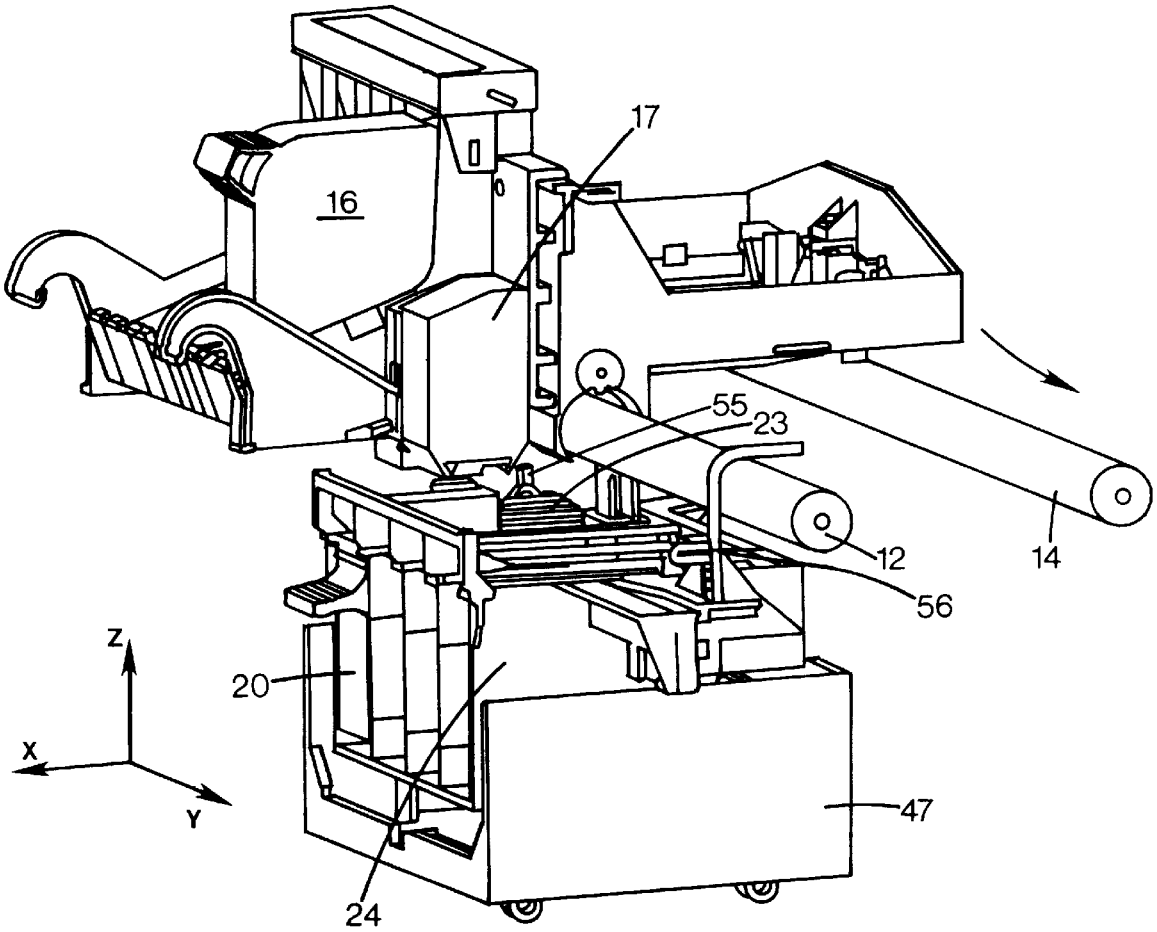
FIG. 14 shows the carriage assembly, including the printer carriage moving in the Y direction along slider rods to the right hand side of the printer where the service station is located.
Figure 17:
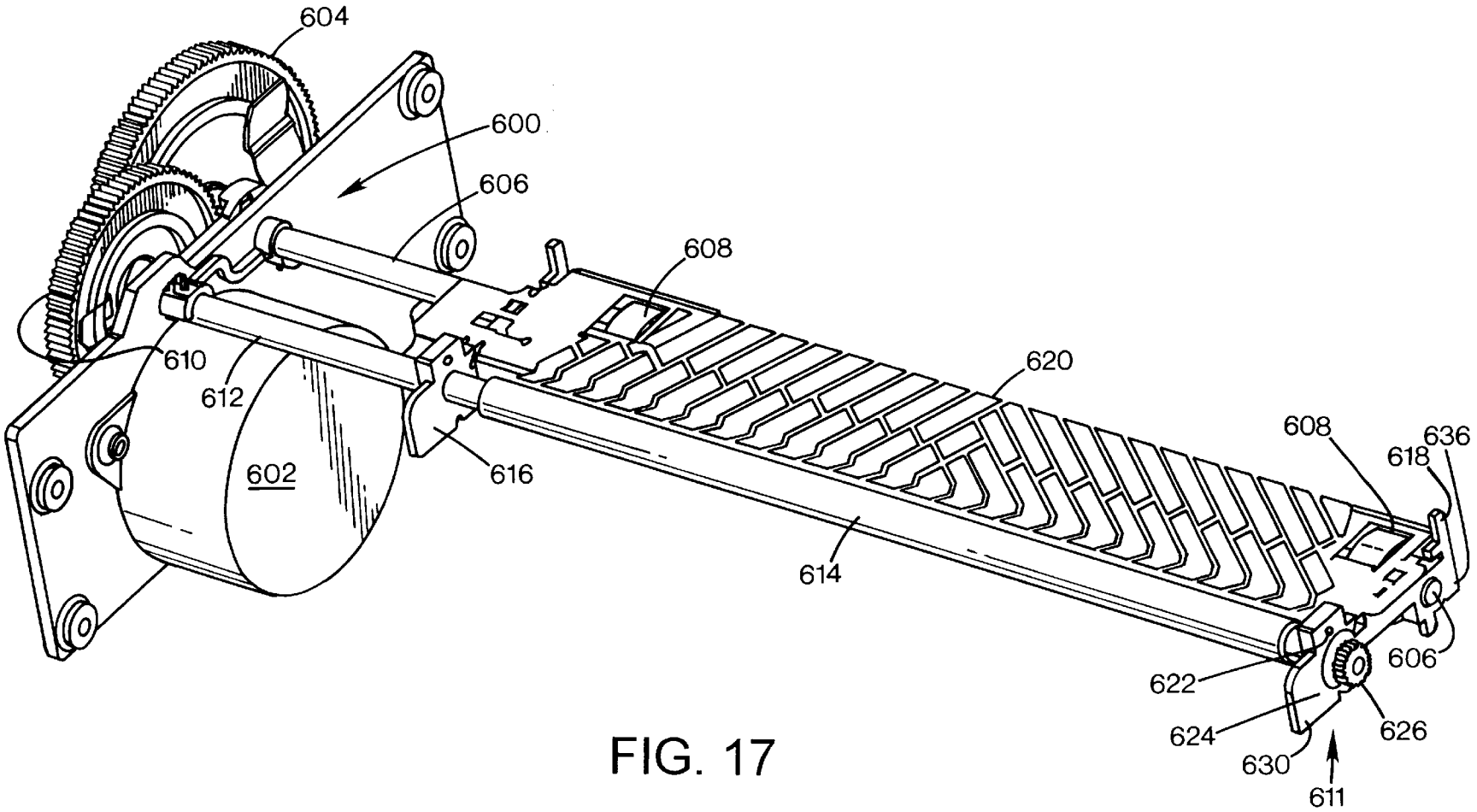
FIG. 17 is a perspective view showing a media advance drive roller system for a print zone, with an alternate service station drive gear mounted on one end of a media advance drive axle.
Figure 18:
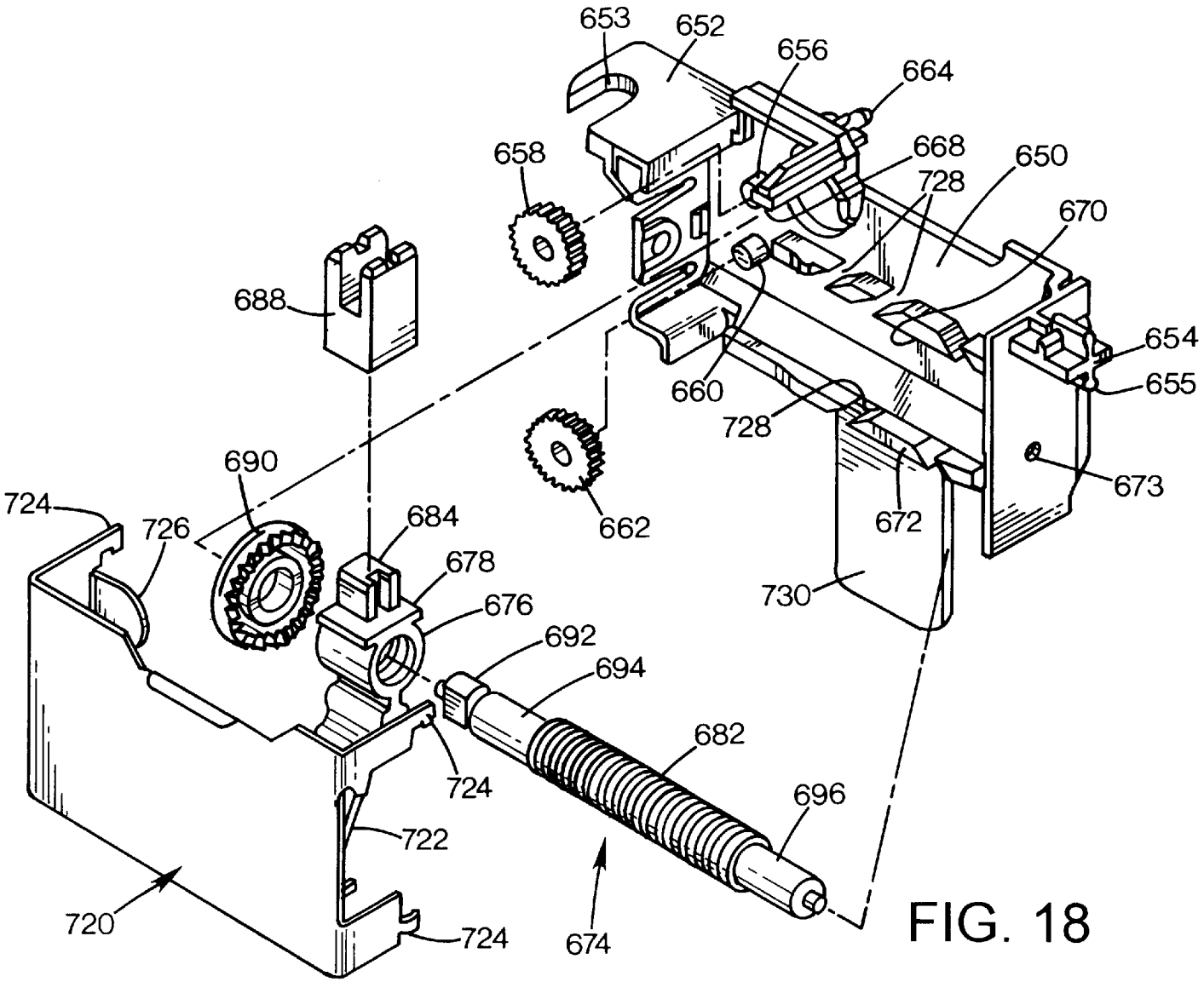
FIG. 18 is an exploded view of an alternate service station.
Figure 19:
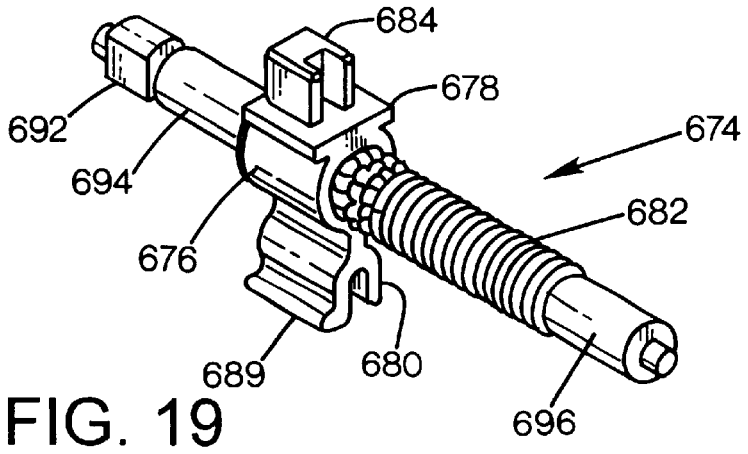
FIG. 19 shows a wiper base on a lead screw of the alternate service station.
Figure 20:
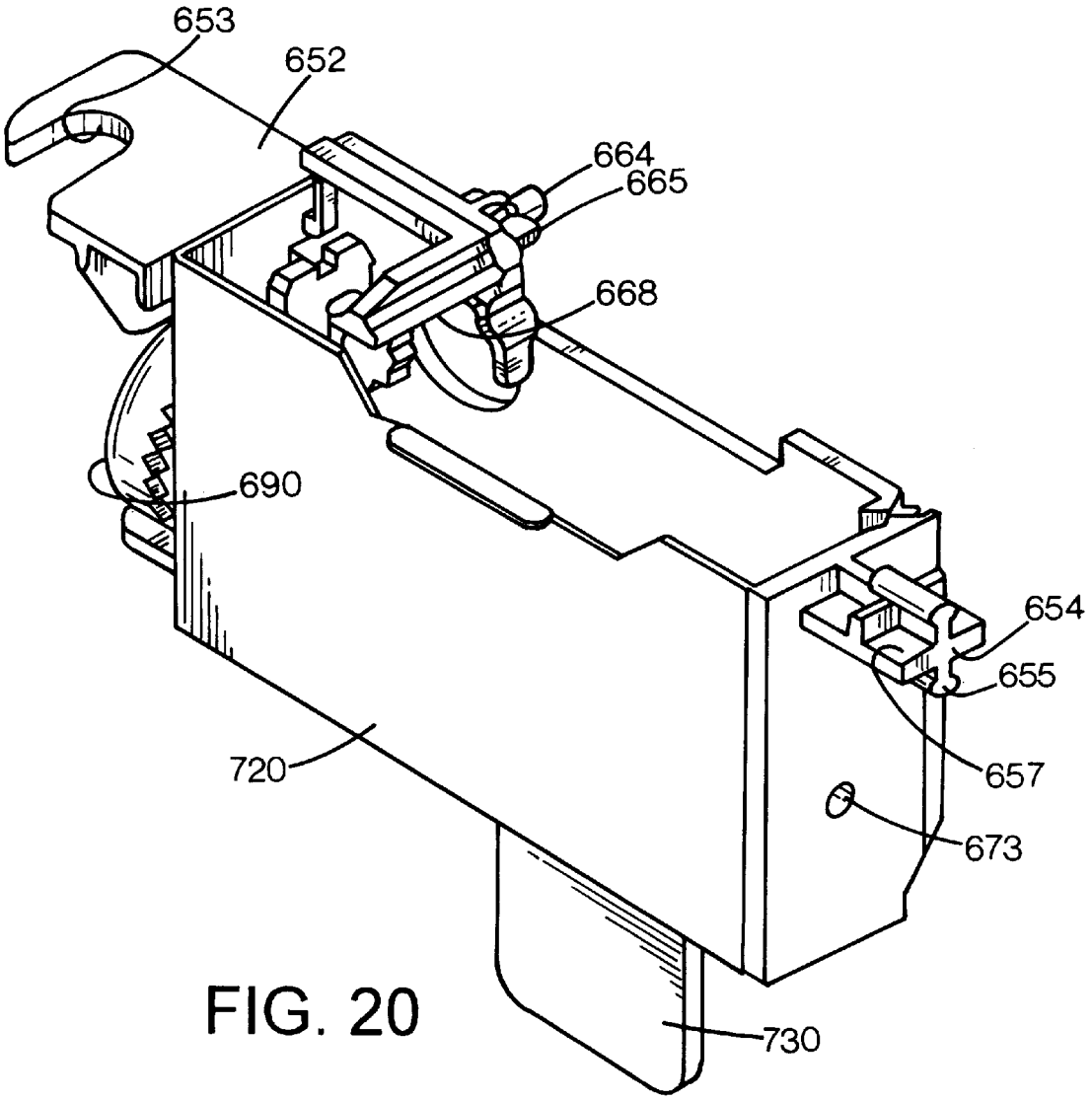
FIG. 20 is a perspective view of an alternate service station ready for installation on the printer, with a wiper unit in parked position.
Figure 21:
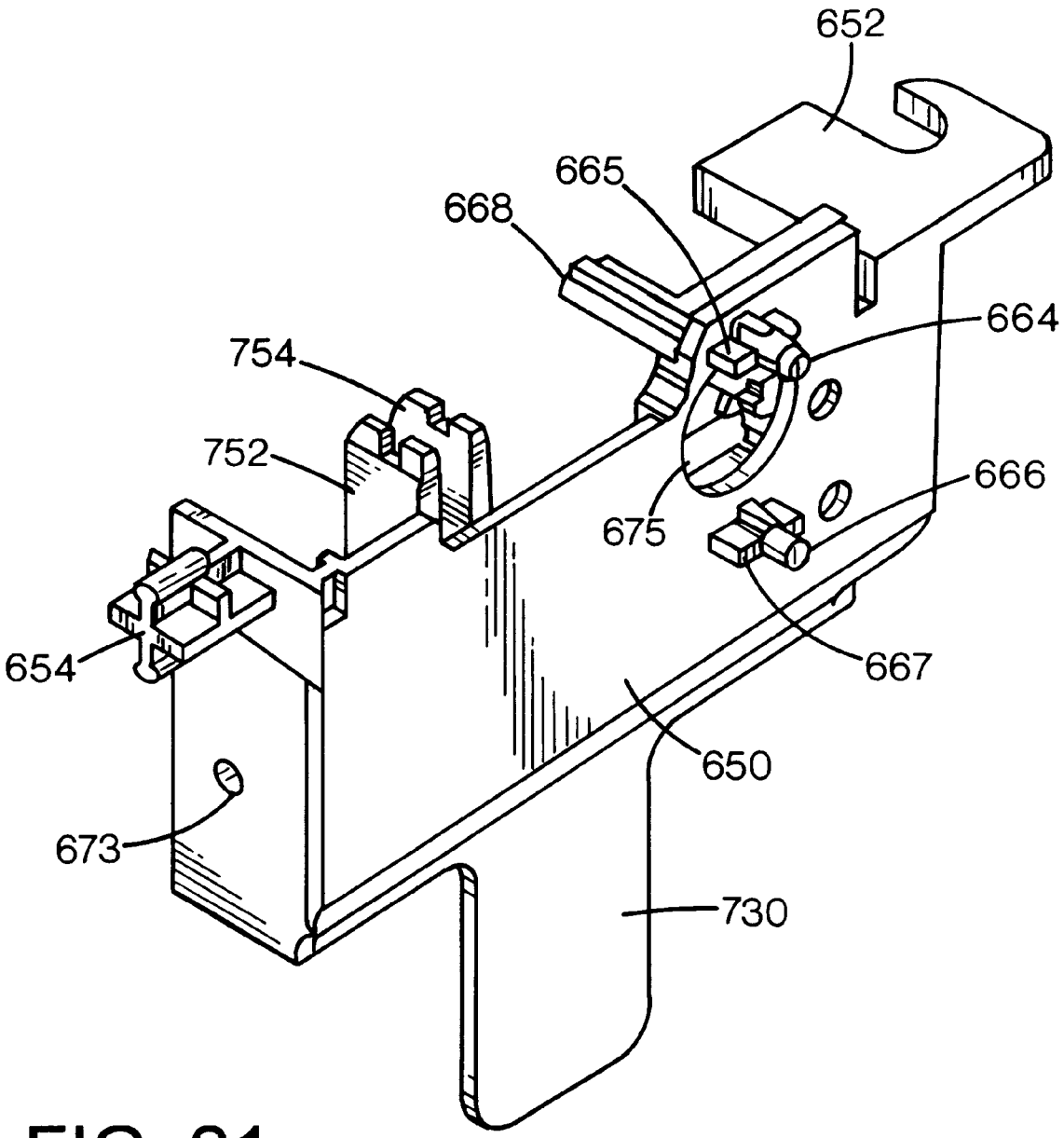
FIG. 21 is a perspective view of a housing portion of the alternate service station.

FIG. 14 shows the carriage assembly, including the printer carriage 10 (shown holding only one rather than four cartridges for clarity) moving in the Y direction along the slider rods 12 and 14 to the right hand side of the printer where the service station is located. Also shown are the service station assembly 47 and the service station carriage 24 holding only one rather than four service modules 20 again for the sake of clarity. In order to perform a capping operation, the carriage assembly aligns the printer carriage with the service station carriage in the Y direction and the service station assembly is moved in the X direction and then the Z direction. As the service station carriage 24, within the service station assembly 47 is moved in the Z direction the caps 23 of the four service modules 20 contact the printheads of the four cartridges 16. The caps 20 are slightly deflected and form a seal around the printheads 18 shortly before the mechanical stops 55, 56, 57 and 58 of the service station carriage 24 abut the mechanical stops 59, 60, 61 and 62 of the printer carriage 10. The abutment of the mechanical stops defines a fixed separation between the service station carriage 24 and the printer carriage 10. Thus the desired deflection of the cap (sometimes called the capping interference) can be easily set when designing the capping system and, since the relationship between capping interference and capping force can be measured (for example as shown in FIG. 17), the desired capping force is also easily set. Furthermore, since the capping interference for a particular cap and printhead pair is unaffected by that for any other pair it is far easier to ensure that the tolerances affecting one pair are such as to always achieve an effective capping interference.

The floating mounting of the service station carriage 24 within the service station assembly 47 ensures that any misalignment between the two carriages is corrected and also that any further movement of the carriage assembly 47 in the Z direction once capping has occurred does not cause additional forces to be exerted on either the printer carriage 10 or the cartridges 16.

Figure 15B:
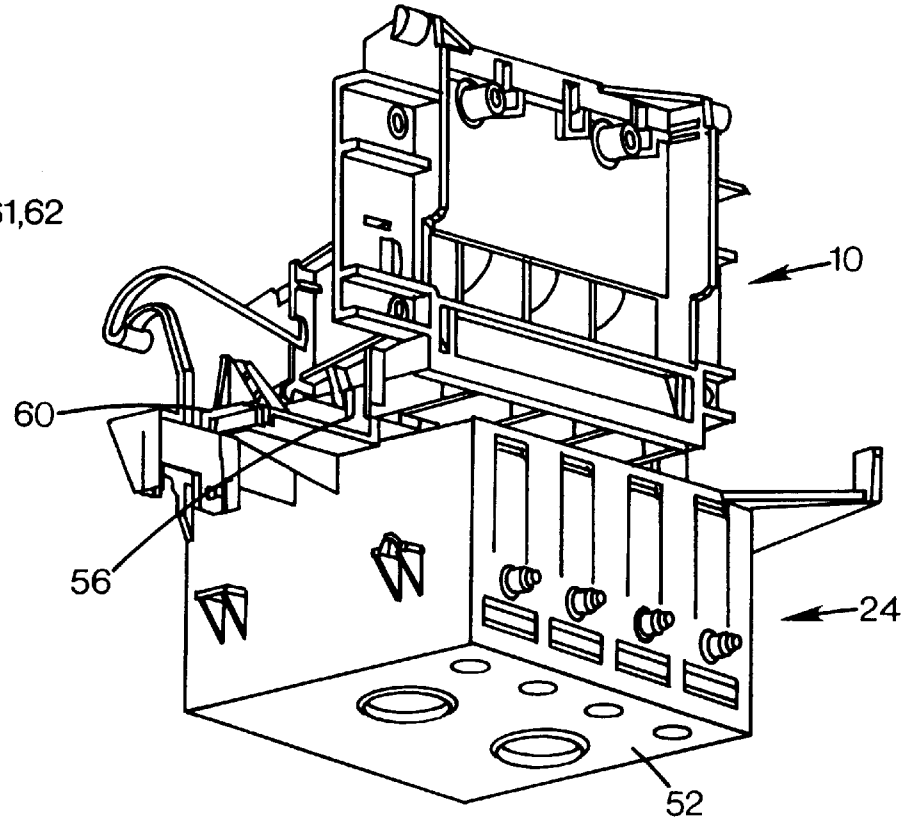
FIG. 15B shows a lower rear perspective view of the service station carriage fully engaged with the printer carriage.
Figure 15A:
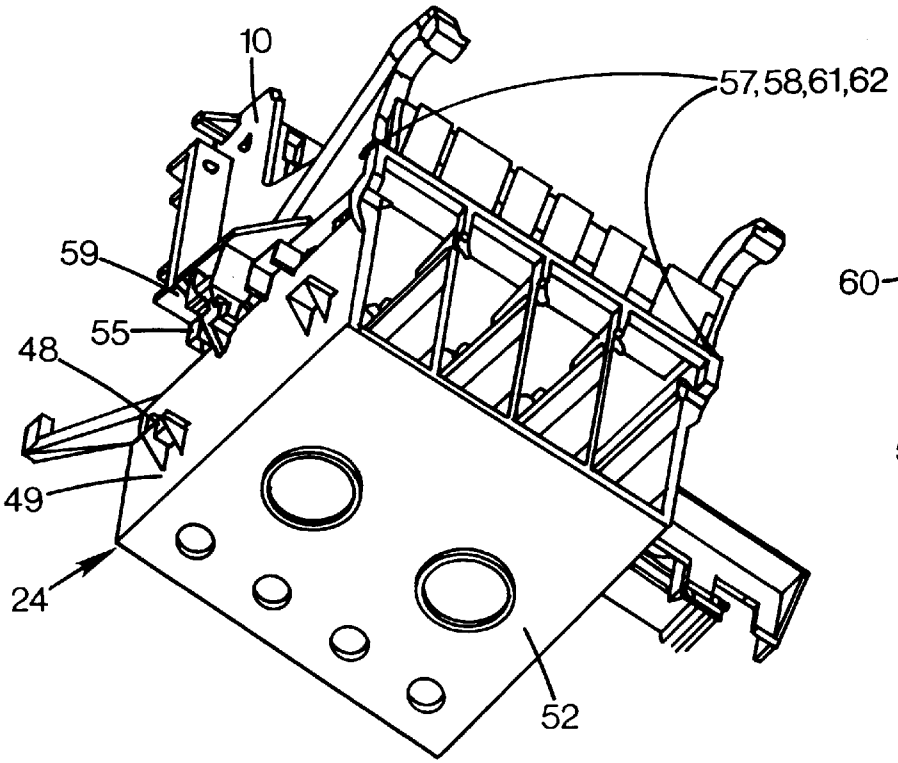
FIG. 15A shows a lower front perspective view of the service station carriage fully engaged with the printer carriage.

FIG. 15A shows a lower front perspective view of the service station carriage 24 fully engaged with the printer carriage 10 without any other components of the printer so that the engagement of mechanical stops 55 and 59 and 57, 58 and 61, 62 can be seen. FIG. 15B shows a lower rear perspective view of the service station carriage 24 fully engaged with the printer carriage 10 without any other components of the printer so that the engagement of mechanical stops 56 and 60 can be seen.

Figure 16:
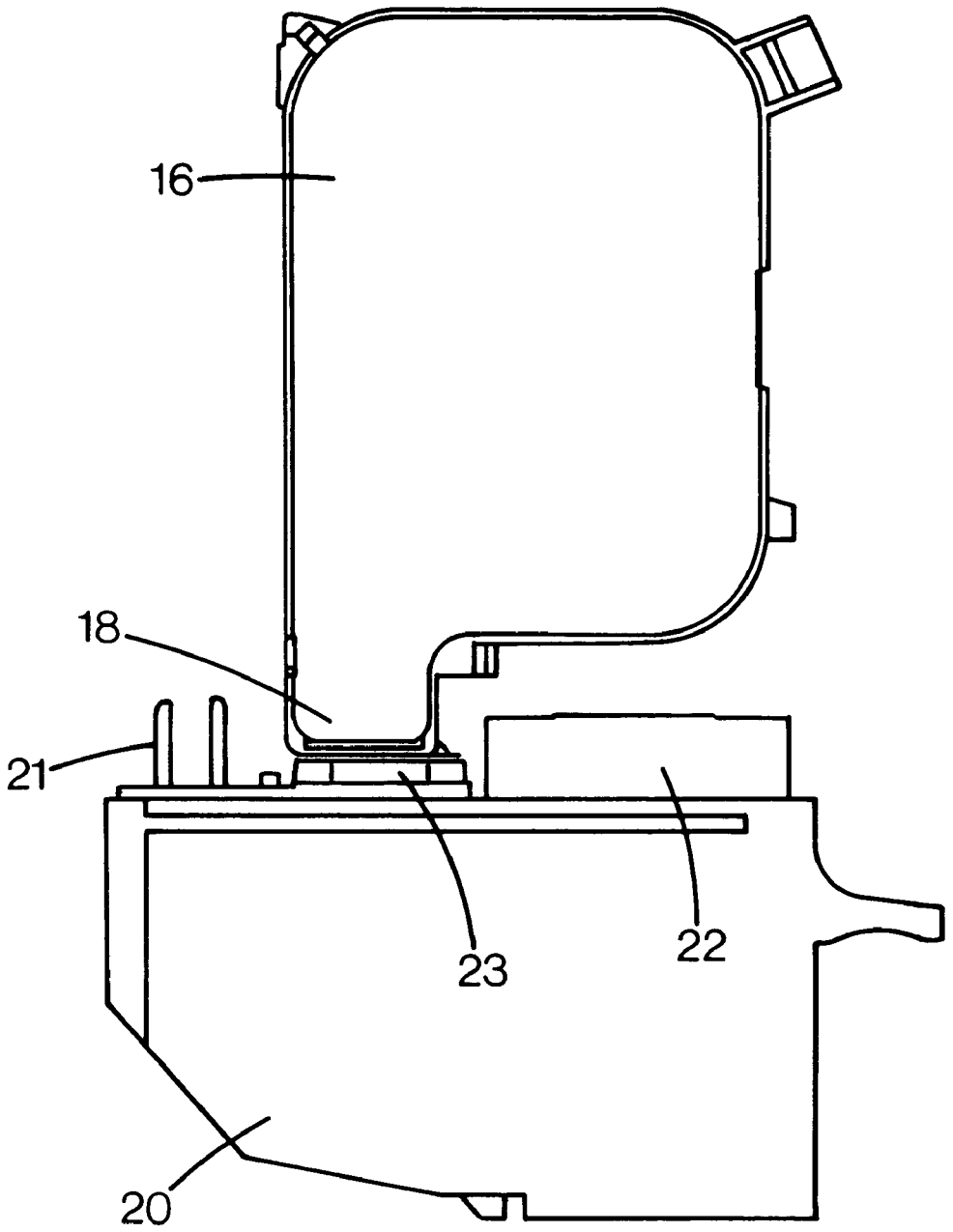
FIG. 16 shows a side view of a single service module 20 in capping engagement with a cartridge.

FIG. 16 shows a side view of a single service module 20 in capping engagement with a cartridge 16 without any other components of the printer so that their relative configuration can be seen.

[The perspective view of FIG. 17 shows how a first service station 50 can be actuated by a media advance motor, and also identifies one frame of reference for use in positioning a wiper unit in the first service station relative to the printhead and to the printer platen. In that regard, the media advance system for an inkjet printer with a heated print zone such as the Hewlett-Packard DeskJet 1200 C inkjet printer includes a vertical support plate 600, a stepper motor 602, a main drive gear 604 which drives a first axle 606 carrying primary drivewheels 608, a secondary drive gear 610 which drives a second axle 612 carrying secondary driveroller 614. Left and right bushing plates 616, 618 provide precise positioning of the drivewheels 608 and the driveroller 614 closely adjacent to a screen platen 620 which supports media passing through a heated print zone.

In the present invention, the right bushing plate 618 is modified to provide precise positioning of a unique first service station unit which is located next to the right bushing plate. The right bushing plate includes a top hole 622 and a bottom hole 624 for positional mounting of the first service station unit. A service station drive gear 626 is fixedly mounted on the right end of second axle 612. A front datum projection 630 fits into matching slot 632 on a service station chassis 634, while a rear datum projection 636 fits into another matching 30 slot 638. Thus the service station chassis provides another frame of reference for positioning a wiper unit in the first service station relative to the printhead and to the printer platen.

The structural details of the first service station unit are best shown in FIGS. 18–21. A housing 650 includes a front mounting tab 652 with screw slot 653, back mounting tab 654 with walls 655, 657, top bearing pin 656 for rotatably mounting top spur gear 658, bottom bearing pin 660 for rotatably mounting bottom spur gear 662, externally projecting mounting members (for holes 622, 624, respectively) such as a secondary top mounting pin 664 with spacer 665 and primary bottom mounting pin 666 with spacer 667, scraper 668, upper and lower cam surfaces 670,672, and forward and rear bearing holes 673 for rotatably mounting a lead screw 674. A large opening 675 in the housing 650 allows drive gear 626 to extend through a housing wall for engagement with spur gear 658, thereby providing a gear train through bottom spur gear 662 to face gear 690. Chassis hole 677 is positioned for attaching alignment with screw slot 653, and chassis slot 679 is positioned for engagement with walls 655, 657.

A nut member is provided to form a wiper base 676 which has upper and lower cam followers 678, 680 which respectively track upper and lower cam surfaces 670, 672 as the wiper base moves in a back-and-forth linear motion along a central threaded portion 682 of the lead screw 674. An upwardly projecting key shaft 684 on the wiper base 676 is shaped to engage a matching interior mounting channel 686 of a removable wiper blade 688. An extending toe 689 on the wiper base provides asymmetry to avoid assembling the wiper base facing in the wrong direction on the leadscrew.

A face gear 690 is mounted on a square hub 692 of the lead screw 674 as the last element in a gear train to rotatably drive the lead screw. The lead screw 674 includes unthreaded front and back portions 694, 696 to provide temporary parking positions for the wiper base after it has traversed along the central threaded portion 682 during rotation of the lead screw by the face gear.

A cover 720 is sized and shaped to fit together with the housing 650 to form a spittoon in the first service station. The cover includes a front spring arm (not shown) and a back spring arm 722 to urge the wiper base into engagement with the central threaded portion 682 during appropriate time periods of the wiping procedure. Arm hooks 724 are provided for engagement with matching slots on the housing, and tab plates 726 service to hold the spur gears 658, 662 in position in the housing. To facilitate movement of the wiper member 688 back and forth along the lead screw, slots 728 in both upper and lower cam surfaces 670, 672 allow ink to descend down into a bottom spittoon area (not shown) where an enlarged diaper pad absorbs excess ink. Also, an elongated wicking member 730 extends downwardly from the housing to help draw residual liquid ink down and away from important moving printer parts and away from the print zone. The back-and-forth movement of the wiper member 688 also helps to avoid crippling buildup of ink in the spittoon.

Figure 22:
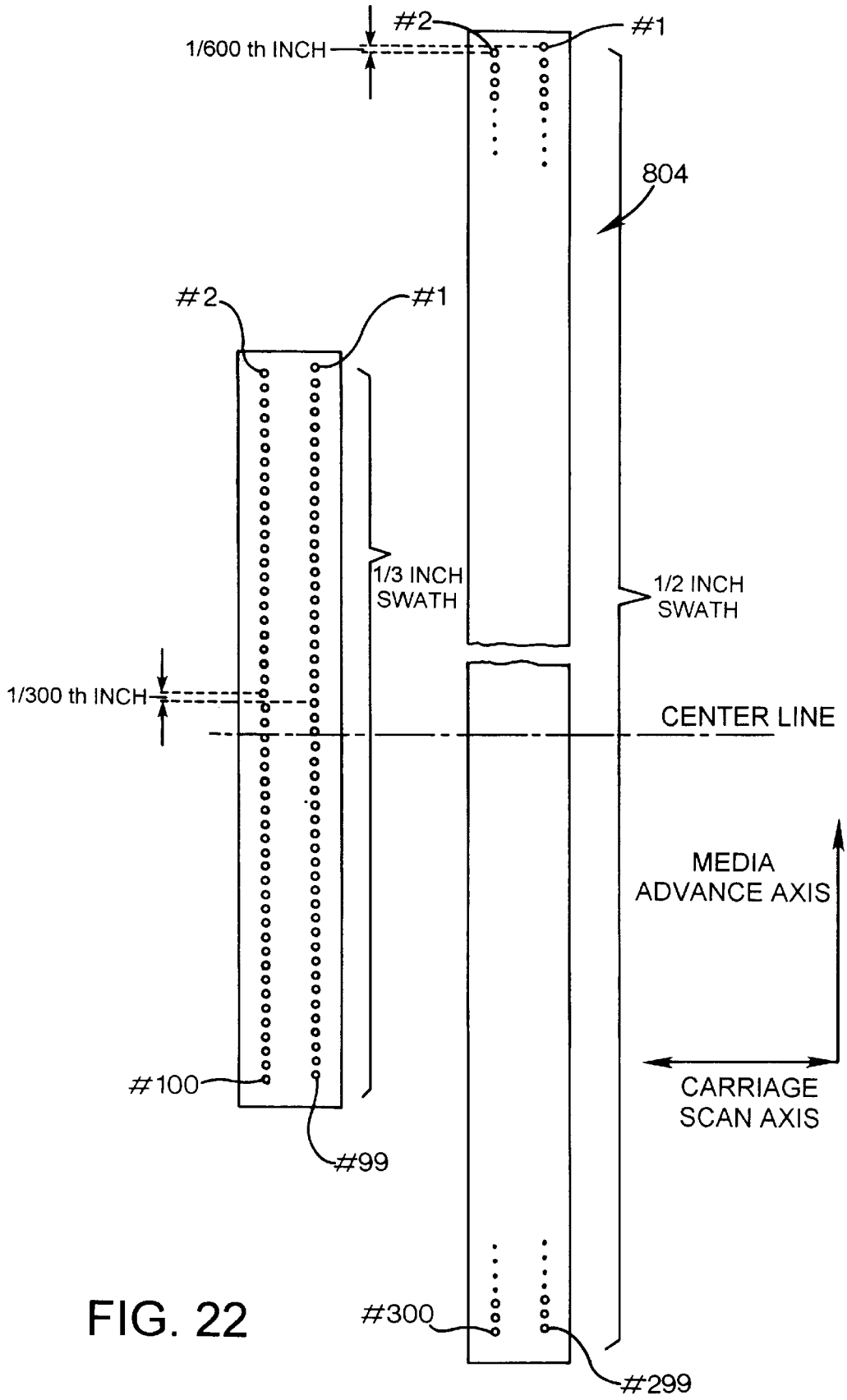
FIG. 22 schematically shows the nozzle arrays for a wide swath 600 dpi black ink printhead and a narrow swath 300 dpi color ink printhead, respectively, which can be serviced by the service station methods and techniques of the present invention.

The split configuration of each wiper is particularly designed for use with inkjet nozzle arrays having two columns of ink orifices, such as a ⅓ inch swath printhead 802 with approximately one hundred nozzles in a 300 dpi array and/or a ½ inch swath printhead 804 with approximately three hundred nozzles in a 600 dpi array (see FIG. 22).

Figure 23A:
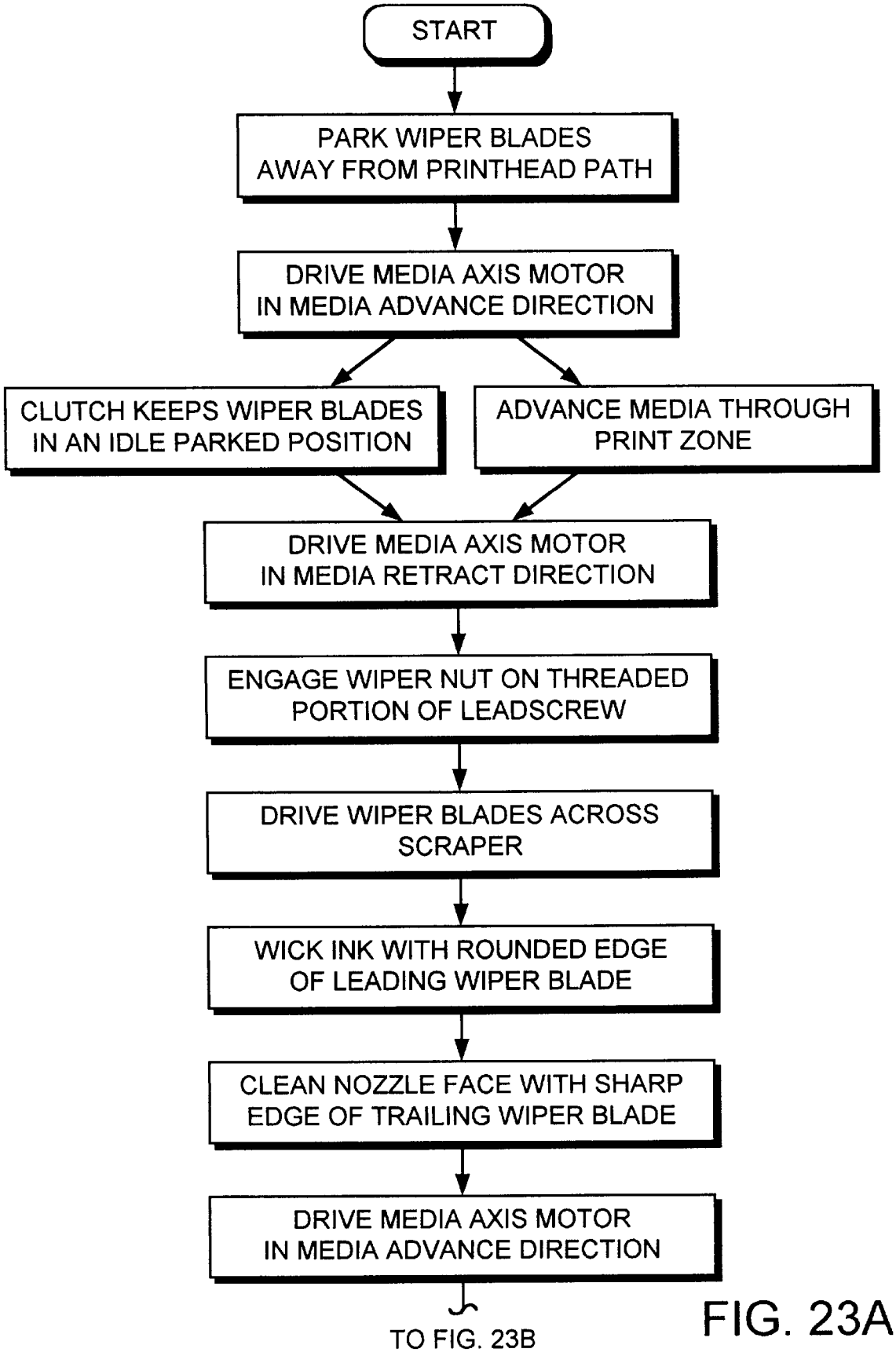
FIGS. 23A and 23B are a flow chart showing the service station methods and techniques of the alternate service station.
Figure 23B:
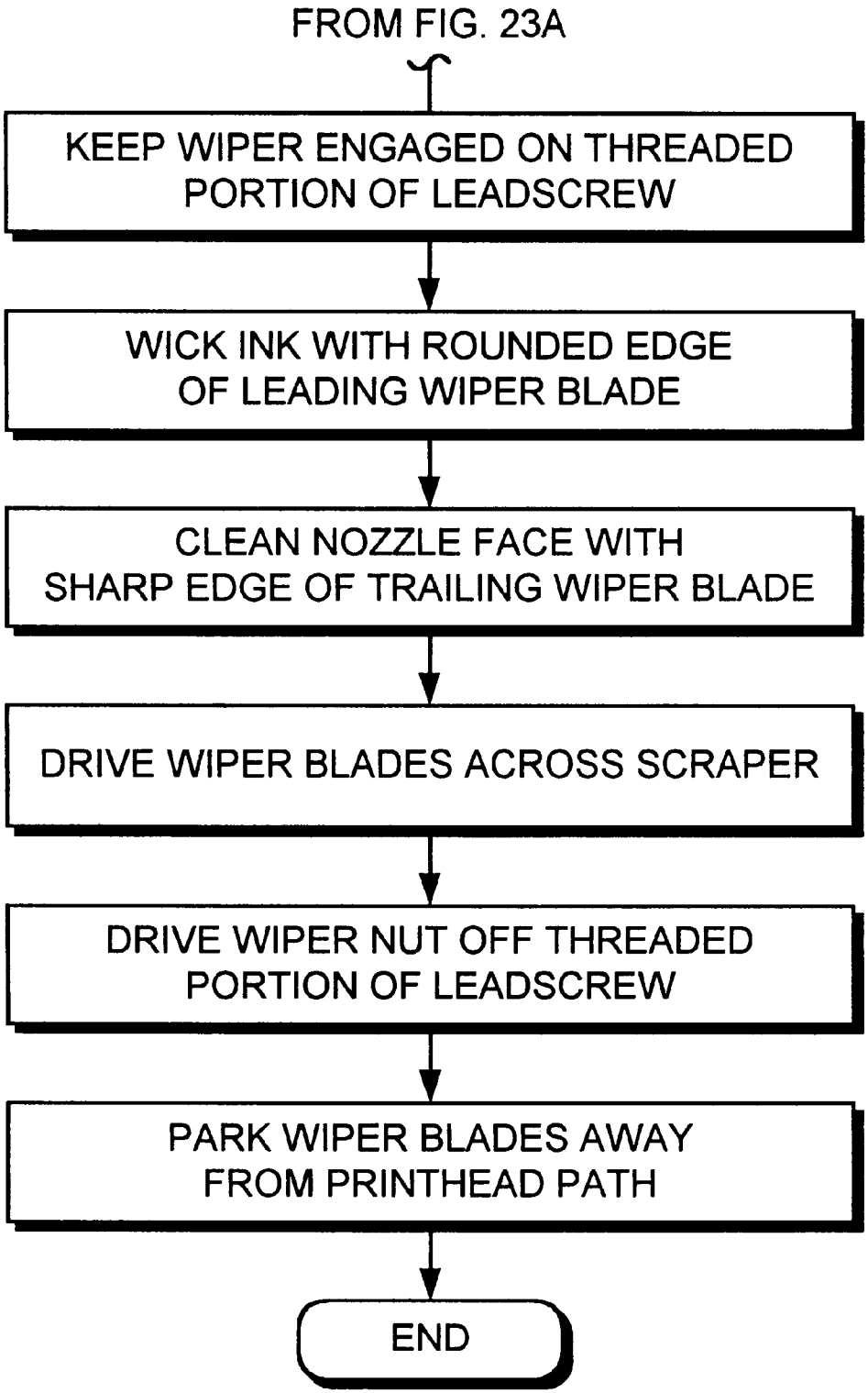

In accordance with all of the foregoing, the first service station provides for the unique wiping/scraping procedure as set forth in the flow chart of FIGS. 23A–23B. It will be understood from the self-explanatory flow chart that initially the wiper blades are parked in an idle position with the wiper base in a home position on the unthreaded portion of the lead screw, even though the lead screw continues to rotate during a printing operation. After the printing operation is completed and the media is advanced out of the print zone, a scheduled wiping operation is commenced by reversing the stepper motor to activate the first service station. As the threads of the lead screw engage the wiper nut, the flexible wiper blade edges are first driven across the rigid scraper to clean them in order to avoid damaging the nozzle surface, and then are driven across the ink orifices for the wicking/cleaning actions previously described. The cycle is completed by reversing the stepper motor to again accomplish the wicking/cleaning actions followed by the step of scraping the flexible wiper blade edges. The threaded wiper base then moves into an idle or parked position due to the clutch action of the unthreaded portion of the lead screw. It is to be noted that while the accumulation of ink on a nozzle surface of the printhead is normally an undesirable thing, in this instance the wicking of ink from a nozzle array by the rounded edge of the leading wiper blade is very important here to achieve successful cleaning of the nozzle surface by lubricating the nozzle surface and by resolubalizing any residual dried ink on the nozzle surface.

Figure 24:
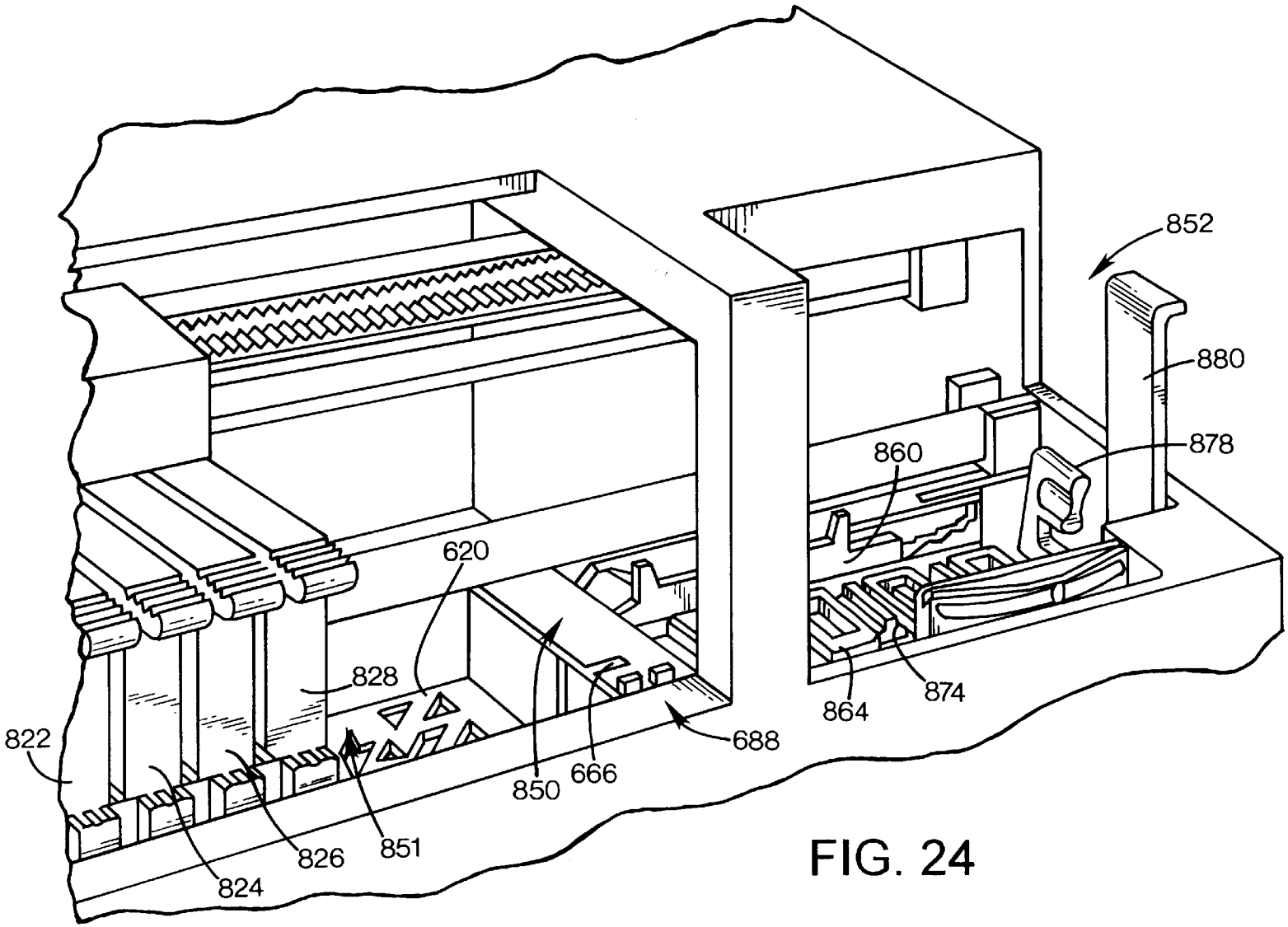
FIG. 24 is a close-up perspective view of an alternate service station unit which has been installed in the inkjet printer of FIG. 1.
Figures 25A, 25B:
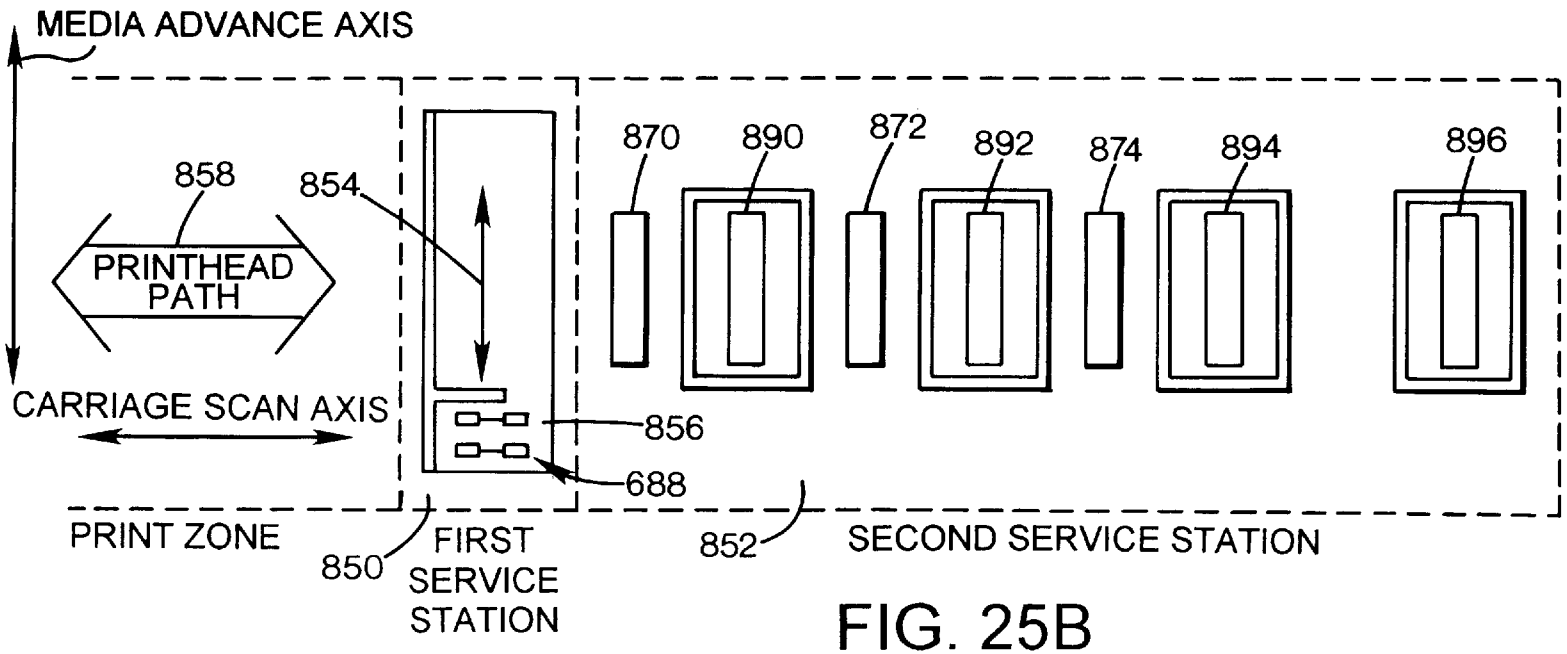
FIGS. 25A and 25B are tabular and schematic representations showing the allocation of printhead services between first and second service stations which are incorporated in the service station unit of FIG. 24.

As shown in FIGS. 24 and 25A–25B, the service station functions of the present invention are generally divided between a first service station 850 which is immediately on the right of a print zone 851 and a second service station 852 which is on the right of the first service station. The service functions of each are set forth in tabular form in FIG. 25A, and shown schematically in FIG. 25B. The direction of the translational back-and-forth wiping of the 600 dpi pigment based black ink printhead is identified by arrow 854 which is orthogonal to the carriage scan axis. Moreover, a home location 856 for parking wiper blade member 688 during an actual printing operation is located away from printhead path 858, to avoid interference with any of the printheads which extend into the service station section of the printer at the end of each printing swath.

Figure 26:
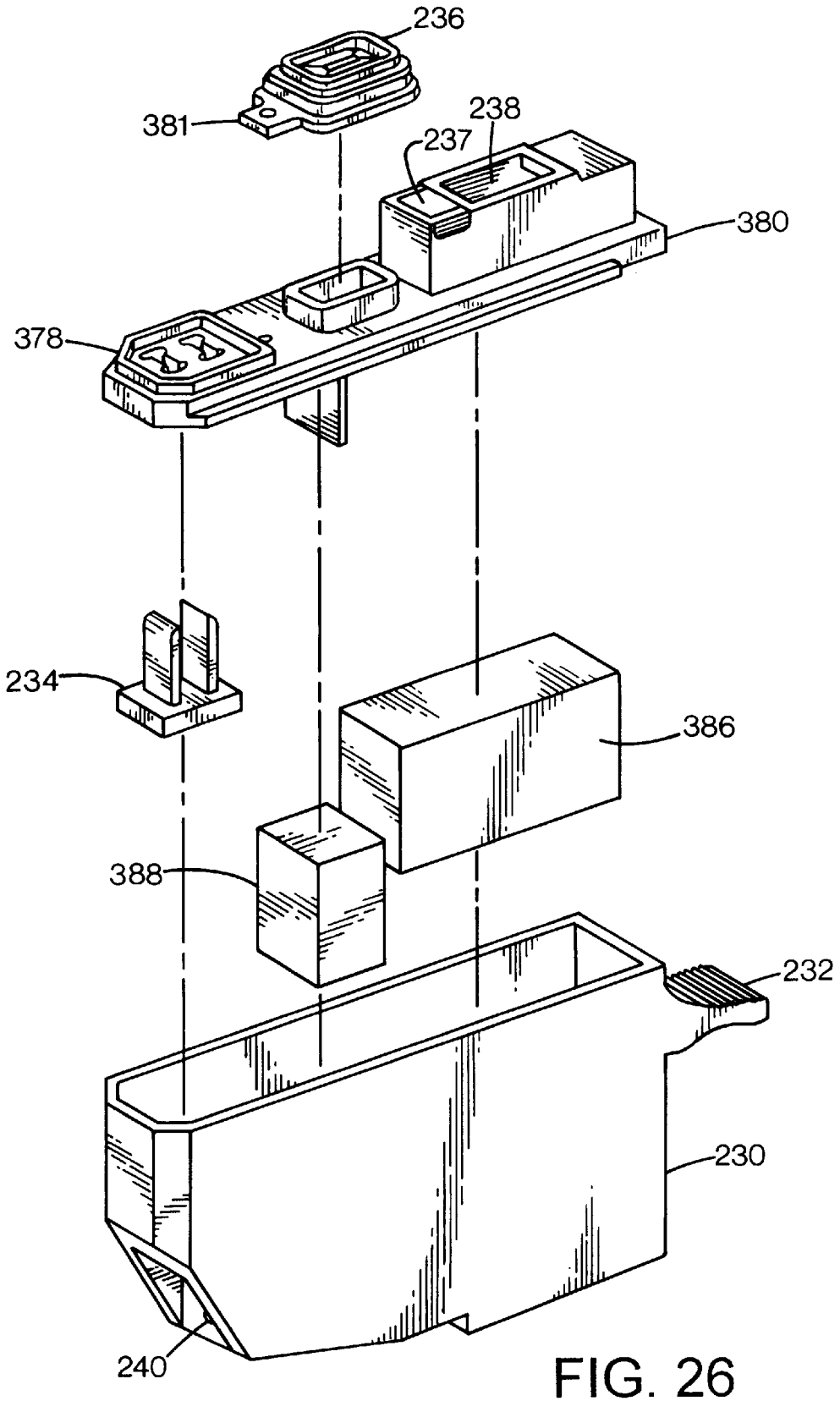
FIG. 26 is an exploded view of a presently preferred embodiment of the printhead service module shown in FIG. 4.

Additional details of the service station module 230 are shown in FIG. 26 in conjunction with FIG. 4. A unitary body portion defines various internal chambers and passages as well as providing a support for a top plate 380 which extends all the way across a top opening in the body portion. The spittoon is in a raised position at one end of the top plate. The cap 236 is positioned and secured on the top plate with the help of a mounting tab 381, and both wipers 234 are incorporated in a single unitary part also mounted on the top plate. A drain 278 next to the wipers feeds ink from the wipers into a waste chamber located in the body portion.

The primer port 240 connects through passages in the body portion to the cap. A main ink collection chamber 382 is directly under the cap and is separated from a secondary chamber 383 by a baffle 384 extending down from the top plate. In order to help prevent undue ink buildup, a larger absorbent foam block 386 is employed in the bottom of a spittoon collection chamber 385 and a similar smaller absorbent foam block 388 is placed in the bottom of the chamber 382.

As shown in FIG. 27, the translational movement of the service station facilitates the positioning of the wiper components, primer & cappers, label, spittoon, and handle in the appropriate positions for interaction with the printheads as well as manual removal/replacement by a user.

Additional details of the service station mechanism on the printer are shown in FIGS. 5 and 7–10. The service station 251 has primer tubes 389 attached from the rear to the respective primer ports 240. A motor 390 is provided to move a platform 391 along slide rods 392 as part of various servicing operations as well as to position the carriage for installation or removal of individual modules by a user. The entire service station mechanism is supported by a chassis 394, and the platform includes a rear access 395 for the primer tubes 389 as well as a front access 396 to facilitate the aforementioned installation or removal of individual modules from the service station carriage.

The service station has a set of four (one per printhead) disposable cassettes each containing: small spittoon for one printhead, to accumulate the ink spitted during the servicing of the printhead; cap for one printhead, to avoid evaporation through the nozzle plate; ink separator, where primed ink accumulates; double wiper for one printhead, to keep its nozzle plate clean; and label to monitor the usage of each cassette.

In order to have flexibility in parameters such as wiping speed/interference, capping force, etc., a mechanism with 2-degree freedom of motion has been selected. The mechanism can position the service cassette in Z and X directions, getting the 3rd degree of freedom (Y) with the carriage movement. The functions of the service station mechanism are: position the service cassette in the different locations needed to perform the servicing tasks; allow the user to change the cassettes; press the service cassettes with a force that assures a perfect sealing of the four caps against the nozzle plate; and move the wipers with a minimum speed to clean the nozzle plate. This motion must be in a horizontal plane and normal to the motion of the printhead carriage.

To perform all these functions, the invention combines horizontal with vertical motions. In the preferred embodiment, we use a mechanism with two independent degrees of freedom.

In the horizontal motion a worm drive was chosen because of its simplicity and anti-push-back. This second characteristic is important to counteract the force from a user to push back when changing the cassettes. The worm is driven using a stepper motor for positioning without encoder. A gear drive between the motor and the worm increases its speed by a factor of three.

In the vertical motion a five bar mechanism guides vertically the cassettes and is driven by a linear actuator. A linear actuator is basically a stepper motor with a female thread in its rotor and a long worm that is fastened at its end to avoid its rotation.

It was a manufacturing goal for this design to be modular, that is, the whole service station unit can be assembled and tested before attaching it to the printer. Therefore, a service station holder was designed to hold not only the service station mechanism but also the primer and an interconnect board. Therefore, with only four screws and a single cable the whole service station is assembled in the main production line.

The accumulation of ink in the service station is a subject of concern because it can increas the friction in the mechanism. Room for a fan has been allocated in the service station holder. This fan sucks air from the service station area, pushes it through a filter, and to the outside of the printer (there is a grid in the cover). The cassette has a label where the printer can read and write, to know at any time the usage and the remaining life for any of those service cassettes.

The various positioning components as described above are identified in the drawings (see FIGS. 7–9) as horizontal stepper motor 370, first horizontal worm 400, transfer gear 401, gear drive 402, vertical stepper motor 404, second horizontal worm 406, and vertical pivot bars 408. The other motorized components include the primer assembly 410 and the fan assembly 412.

It is to be understood that certain features of the service station module and the service station carriage are optional and are not required in order to obtain the benefits of the invention.

Thus, once the service station modules are securely positioned in the service station carriage, all of the various important servicing functions (wiping, capping, priming, spitting, or selected sub-groups thereof) required for reliable operation of an inkjet printhead can be done in conjunction with a single module or cleaner which is dedicated solely to a single printhead and which can be removed and replaced at the same time that the associated printhead is removed. Thus the coordination of expected life of the service station module, ink supply module and printhead is an important feature of the invention. When a different ink supply such as UV ink for outdoor usage is required, an entire ink delivery system (including ink and ink-related components) can be easily replaced.

While the present invention is open to various modifications and alternative constructions, the preferred embodiments shown in the drawings will be described herein in detail. It is to be understood, however, that there is no intention to limit the invention to the particular form disclosed. On the contrary, the intention is to cover all modifications, equivalences and alternative constructions falling within the spirit and scope of the invention as expressed in the appended claims.

We claim as our invention:

1. An inkjet printing system comprising:

a carriage which moves along a scan axis over a print zone;

media which moves through the print zone;

a plurality of printheads mounted on said carriage, each printhead having an array of nozzles for applying ink to said media in said print zone;

a plurality of servicing modules each having at least one wiper for engagement with a corresponding one of said array of nozzles during a period when said carriage is in a stationary position and said nozzles are not applying ink to said media;

a service station carriage holding the plurality of servicing modules in a fixed position relative to the service station carriage during servicing operations;

a motor to move the service station carriage in a linear direction orthogonal to said scan axis in order to simultaneously wipe each array of nozzles of said plurality of printheads when the carriage is in the stationary position.

2. A system servicing an inkjet printhead mounted in a scanning carriage without having to remove the printhead from the carriage, comprising:

a printer frame;

a carriage mounted on said frame for scanning movement along a scan axis across a print zone;

an inkjet printhead on said carriage and having ink ejection nozzles;

a service module having a wiper and a capper adapted for periodic engagement with said nozzles;

a holder to support said service module, the service module, wiper and capper held in a fixed position relative to the holder during service operations; and a motorized device coupled to said holder to move said holder and said service module in a linear direction orthogonal to said scan axis into a first position which provides engagement of said wiper with said nozzles and into a second position which provides engagement of said capper with said nozzles.

3. The system of claim 2 wherein said motorized device moves the holder in a capping direction orthogonal to said scan axis and said linear direction to provide said engagement of said capper with said nozzles.

4. The system of claim 3 wherein said motorized device further moves the holder in said linear direction to provide said engagement of said capper with said nozzles.

5. The system of claim 2 wherein said service module further includes a spittoon, and said motorized device moves said holder in a spittoon direction orthogonal to the scan axis to bring the spittoon to a position which allows the nozzles to discharge ink into the spittoon.

6. The system of claim 2 wherein said service module further includes a primer function with said capper.

7. A method of servicing a plurality of inkjet printheads each having at least one nozzle array, comprising the steps of:

moving the printheads along a scan axis into a first fixed position;

providing a service station carriage holding a plurality of servicing modules with a plurality of wipers; and passing the service station carriage and the wipers in a linear direction orthogonal to the scan axis with the wipers held in a fixed position relative to the service station carriage to respectively engage the nozzle arrays of the plurality of inkjet printheads.

8. The method of claim 7 wherein said providing step includes providing said plurality of service modules each with a capper, and said passing step includes passing the service station carriage with said cappers in a linear direction orthogonal to the scan axis to a first position which allows the cappers to respectively engage the nozzle arrays of the plurality of inkjet printheads.

9. The method of claim 7 wherein said providing step includes providing said plurality of service modules each with a spittoon, and said passing step includes passing the service station carriage with the spittoons in a linear direction orthogonal to the scan axis to a second position which allows the nozzle arrays to discharge ink into the spittoons.

10. The method of claim 7 wherein said providing step includes providing said plurality of service modules each with primer device, and said passing step includes passing the service station carriage with the primer devices in a linear direction orthogonal to the scan axis to a third position which allows the primer devices to engage respectively the nozzle arrays of the plurality of inkjet printheads.

11. The method of claim 7 wherein said providing step includes providing said plurality of service modules each with a capper, the method further including passing the service station carriage with the plurality of service modules and cappers in said linear direction and in a capping direction orthogonal to the scan axis and to the linear direction to respectively engage the cappers with the nozzle arrays of the plurality of inkjet printheads.

12. The method of claim 7 wherein said providing step includes providing said plurality of service modules each with a spittoon, the method further including passing the service station carriage with the plurality of service modules and spittoons in said linear direction and in a spittoon direction orthogonal to the scan axis and to said linear direction to a second position which allows the nozzle arrays to discharge ink into the spittoons.

13. The method of claim 7 wherein said providing step includes providing said plurality of service modules each with a primer device, the method further including passing the service stations carriage with the plurality of service modules and primer devices in said linear direction and in a primer direction orthogonal to the scan axis and to said linear direction to a third position which allows the primer devices to engage respectively the nozzle arrays of the plurality of inkjet printheads.

14. A method of servicing a plurality of inkjet printheads each having nozzle arrays, comprising the steps of:

moving the printheads along a scan axis into a first fixed position;

mounting a plurality of service modules each with at least one wiper and with a handle member in a service station carriage; and passing the service station carriage with the plurality of service modules in a linear direction orthogonal to the scan axis to respectively engage the nozzle arrays of the plurality of inkjet printheads with the wipers of the plurality of service modules, said step including passing the service station carriage in a linear direction orthogonal to the scan axis to a position which allows the handle member of each of said plurality of service modules to be manually accessible for removing or replacing or installing one or more of said service modules relative to the service station carriage.

15. A method of servicing a plurality of inkjet printheads each having at least one nozzle array, comprising the steps of:

moving the printheads along a scan axis into a first fixed position;

providing a service station carriage holding a plurality of service modules each with at least one wiper and with a label; and passing the service station carriage and the service modules in a linear direction orthogonal to the scan axis to respectively engage the nozzle arrays of the plurality of inkjet printheads with corresponding wipers, said passing step including passing the service station carriage in a linear direction orthogonal to the scan axis to a position which allows the label to be optically sensed without removing the service module.

16. An inkjet printing system comprising:

a carriage which moves along a scan axis over a print zone;

media which moves through the print zone;

a plurality of printheads mounted on said carriage, each printhead having an array of nozzles for applying ink to said media in said print zone;

a service station carriage holding a plurality of servicing modules in a fixed position relative to the service station carriage during servicing operations;

the plurality of servicing modules each having at least one wiper for engagement with said array of nozzles during a period when said carriage is in a stationary position and said nozzles are not applying ink to said media, and a capper adapted for periodic engagement with a corresponding array of said nozzles; and a motorized system to move the service station carriage and said plurality of servicing modules in a linear direction orthogonal to said scan axis in order to simultaneously wipe each array of nozzles of said plurality of printheads when the carriage is in the stationary position, and to position said cappers in capping engagement with said nozzle arrays.

17. The system of claim 16 wherein said motorized system moves the service station carriage with said plurality of servicing modules in said linear direction and in a capping direction orthogonal to said scan axis and said linear direction to position said cappers in capping engagement with said nozzle arrays.

18. The system of claim 16 wherein said plurality of service modules each further includes a spittoon, and said motorized device further moves the service station carriage and said plurality of servicing modules in said linear direction and in a spittoon direction orthogonal to said scan axis and said linear direction to position the spittoons to a position to allow the nozzle arrays to discharge ink into the spittoons.

* * * * *